US007503644B2

(12) United States Patent
Hori

(10) Patent No.: US 7,503,644 B2
(45) Date of Patent: Mar. 17, 2009

(54) LIQUID EJECTION HEAD, LIQUID EJECTION APPARATUS AND IMAGE FORMING APPARATUS

(75) Inventor: Hisamitsu Hori, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 395 days.

(21) Appl. No.: 11/235,377

(22) Filed: Sep. 27, 2005

(65) Prior Publication Data

US 2006/0066687 A1 Mar. 30, 2006

(30) Foreign Application Priority Data

Sep. 28, 2004 (JP) ..... 2004-282651

(51) Int. Cl.
*B41J 2/045* (2006.01)
*B41J 2/05* (2006.01)

(52) U.S. Cl. ..... 347/68; 347/65

(58) Field of Classification Search ..... 347/70–72
See application file for complete search history.

(56) References Cited

FOREIGN PATENT DOCUMENTS

| | | | |
|---|---|---|---|
| JP | 10-76666 A | | 3/1988 |
| JP | 05138882 A | | 6/1993 |
| JP | 5-330064 A | | 12/1993 |
| JP | 06000958 A | | 1/1994 |
| JP | 07052398 A | | 2/1995 |
| JP | 10-291318 A | | 11/1998 |
| JP | 11058779 A | * | 3/1999 |
| JP | 2000-218802 A | | 8/2000 |
| JP | 2002-200771 A | | 7/2002 |
| JP | 2002200771 A | * | 7/2002 |
| JP | 2002-273881 A | | 9/2002 |
| JP | 2002273881 A | * | 9/2002 |
| JP | 2004-230744 A | | 8/2004 |
| JP | 2004230744 A | * | 8/2004 |

* cited by examiner

*Primary Examiner*—Luu Matthew
*Assistant Examiner*—Lisa M Solomon
(74) *Attorney, Agent, or Firm*—Birch, Stewart, Kolasch & Birch, LLP

(57) ABSTRACT

The liquid ejection head comprises: a plurality of ejection ports through which liquid is ejected; a plurality of pressure chambers which are connected respectively to the ejection ports; a common liquid chamber in which the liquid to be supplied to the pressure chambers is accumulated; a plurality of supply flow channels which connect the common liquid chamber to the pressure chambers; and a plurality of supply restrictors each of which constitutes at least a portion of each of the supply flow channels, wherein at least a portion of one of the ejection ports connected to one of the pressure chambers and a portion of one of the supply restrictors connected to the one of the pressure chambers are processed by means of the same laser beam.

14 Claims, 22 Drawing Sheets

LIQUID EJECTION HEAD, LIQUID EJECTION APPARATUS AND IMAGE FORMING APPARATUS

BACKGROUND OF THE INVENTION

1. Field of the Invention

The present invention relates to a liquid ejection head, a liquid ejection apparatus and an image forming apparatus, and more particularly, to technology for forming supply restrictors and nozzles in a liquid ejection head.

2. Description of the Related Art

An inkjet type image forming apparatus has a print head in which a plurality of nozzles (ejection ports) are arranged in the form of a matrix, and it forms an image on a recording medium by ejecting ink droplets from the nozzles onto the recording medium. Furthermore, there are print heads which are assembled by layering together a plurality of plate members and bonding them by means of an adhesive, or the like. Inside a print head of this kind, ink supply ports (ink flow channels) are provided between pressure chambers connected to the nozzles, and a common liquid chamber which stores ink and supplies ink to the pressure chambers. Supply restrictors having a very fine hole diameter are provided in the ink supply ports or a portion thereof. The supply restrictors function as flow resistors for the liquid flowing through same, and they serve to reduce reflux of ink from the pressure chambers to the common liquid chamber, while stabilizing the ejection of ink from the nozzles.

In image forming apparatuses of this kind, in recent years, there have been demands for even higher image quality. In order to achieve high image quality, it is necessary to form all of the nozzles provided in the print head in a uniform fashion, while ensuring that there is little variation in same. If there are disparities in the nozzle diameter, nozzle positions, or the like, then variations will occur in the amount of ink ejected by the nozzles and in the ink ejection speed, and therefore, differences will appear in the sizes and landing positions of the dots formed on the recording medium, thus leading to reduced image quality. Therefore, technologies for processing the nozzles to a high degree of accuracy have been disclosed (see, for example, Japanese Patent Application Publication Nos. 10-76666, 5-330064, 10-291318 and 2000-218802).

Japanese Patent Application Publication No. 10-76666 discloses technology for forming nozzles by irradiating a laser beam onto a nozzle plate from both the ink input side and the ejection side.

Japanese Patent Application Publication No. 5-330064 discloses technology for forming nozzles by irradiating a broadening laser beam from outside the nozzle surface, onto nozzle forming positions (the nozzle surface) after assembling a print head.

Japanese Patent Application Publication No. 10-291318 discloses technology whereby a plurality of inversely tapered nozzles are processed simultaneously by irradiating light through a telecentric optical system while scanning a laser light source, after assembling a print head.

Japanese Patent Application Publication No. 2000-218802 discloses technology for simultaneously processing a plurality of inversely tapered nozzles by disposing a plurality of masks and a telecentric optical system between a laser light source and a print head, after assembly of the print head, and irradiating a plurality of laser beams corresponding to the mask images onto nozzle forming positions (the nozzle surface) in the print head.

However, in the above-described related arts, although technology for processing nozzles to a high degree of accuracy is proposed, no consideration is given to supply restrictors. Even if nozzles are processed to a high degree of accuracy, if the processing accuracy of the supply restrictors which are connected to the nozzles via the pressure chambers is low, then variations occur in the pressure loss of the supply restrictors. Accordingly, the ratio between the flow channel loss in the supply restrictors and the flow channel loss in the nozzles (pressure loss ratio) become uneven, and the pressure loss balance is not stabilized among the pressure chambers. Therefore, the ink ejection force when ejecting ink droplets from the nozzles is not uniform and this can cause disparities in the ink ejection volume and the ink ejection speed, thus leading to the appearance of differences in the sizes and positions of the dots formed on the recording medium and hence causing deterioration in image quality.

Furthermore, since the supply restrictors and nozzles have a small hole diameter, if foreign matter enters into the common liquid chamber, then blockages may occur in the supply restrictors or nozzles, possibly leading to ejection defects.

SUMMARY OF THE INVENTION

The present invention has been contrived in view of the foregoing circumstances, and it provides a liquid ejection head, a liquid ejection apparatus and an image forming apparatus whereby the pressure loss balance of the supply restrictors and nozzles connected to the respective pressure chambers is stabilized among the pressure chambers, and a strong effect in preventing nozzle blockages is obtained.

In order to attain the aforementioned object, the present invention is directed to a liquid ejection head, comprising: a plurality of ejection ports through which liquid is ejected; a plurality of pressure chambers which are connected respectively to the ejection ports; a common liquid chamber in which the liquid to be supplied to the pressure chambers is accumulated; a plurality of supply flow channels which connect the common liquid chamber to the pressure chambers; and a plurality of supply restrictors each of which constitutes at least a portion of each of the supply flow channels, wherein at least a portion of one of the ejection ports connected to one of the pressure chambers and a portion of one of the supply restrictors connected to the one of the pressure chambers are processed by means of the same laser beam.

According to the present invention, since the ratio of the diameters of the ejection ports and the supply restrictors connected to the respective pressure chambers is uniform in all of the pressure chambers, then the pressure loss ratio is uniform in all of the pressure chambers and the pressure loss balance is stabilized. Consequently, variations in the ejection performance among the pressure chambers is reduced, the ejection liquid volume of the ejection ports is stabilized, and higher image quality can be achieved.

Preferably, at least portions of the ejection ports and at least portions of the supply restrictors connected respectively to the pressure chambers are processed by means of the same row of plurality of laser beams.

According to the present invention, even if there are variations in the laser beams which constitute the laser beam row, it is possible to process a plurality of ejection ports and supply restrictors simultaneously, in one operation, and since the ejection port and the corresponding supply restrictor are processed by means of the same laser beam, then even if there is variation among the ejection ports, the pressure loss ratio in the ejection ports and supply restrictors connected to the pressure chambers is uniform among the pressure chambers, and hence the pressure loss balance is stabilized. Consequently, the volume of liquid ejected from each ejection port is stabilized and higher image quality can be achieved.

Preferably, a minimum opening size of the ejection ports is larger than a minimum opening size of the supply restrictors.

According to the present invention, if foreign matter or the like which is smaller in size than the minimum opening size of the supply restrictors enters into a pressure chamber by passing through the supply restrictor, then it is possible to expel this foreign matter or the like reliably from the ejection port.

Preferably, at least a portion of a member forming the supply restrictors and at least a portion of a member forming the ejection ports are made of substantially the same material.

According to the present invention, it is possible to stabilize and optimize processing of the members yet further, and moreover, warping of the head due to temperature variations can also be reduced.

Preferably, the liquid ejection head further comprises: a plurality of pressure chamber deformation devices each of which causes one wall surface of each of the pressure chambers to deform; and a drive waveform application device which applies a drive waveform to the pressure chamber deformation devices that is different from a drive waveform applied for ejecting the liquid.

According to the present invention, it is able to increase the reflux from the supply restrictors by raising the drive voltage, and therefore, foreign matter can be eliminated readily.

In order to attain the aforementioned object, the present invention is also directed to a liquid ejection apparatus, comprising: the above-described liquid ejection head; and a pressing device which is provided in vicinity of a surface on which the ejection ports are formed, and applies a pressure to the liquid inside the ejection ports in a direction opposite to a direction of flight of the liquid ejected from the ejection ports.

According to the present invention, even if foreign matter or the like forms a blockage in the common liquid chamber, by applying pressure to the liquid inside the ejection ports by means of the pressing device, it is possible to resolve blockages in the supply restrictors.

Preferably, the liquid ejection apparatus further comprises: a supply port through which the liquid is supplied to the common liquid chamber; and an outlet which is capable of expelling the liquid accumulated in the common liquid chamber.

According to the present invention, in addition to achieving the above-described beneficial effects, it is also possible to expel foreign matter and the like to the outside of the common liquid chamber, by causing the liquid to flow inside the common liquid chamber.

In order to attain the aforementioned object, the present invention is also directed to an image forming apparatus, comprising at least one of the above-described liquid ejection heads and liquid ejection apparatuses.

According to the present invention, since the ratio of the diameters of the ejection ports and the supply restrictors connected to the respective pressure chambers is uniform in all of the pressure chambers, then the pressure loss ratio is uniform in each of the pressure chambers and the pressure loss balance is stabilized. Consequently, variations in the ejection performance among the pressure chambers is reduced, the ejection liquid volume of the ejection ports is stabilized, and higher image quality can be achieved.

Furthermore, by providing an expulsion device for foreign matter by forming the minimum opening size of the ejection ports larger than the minimum opening size of the supply restrictors, it is possible to resolve nozzle blockages and ensure high reliability.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
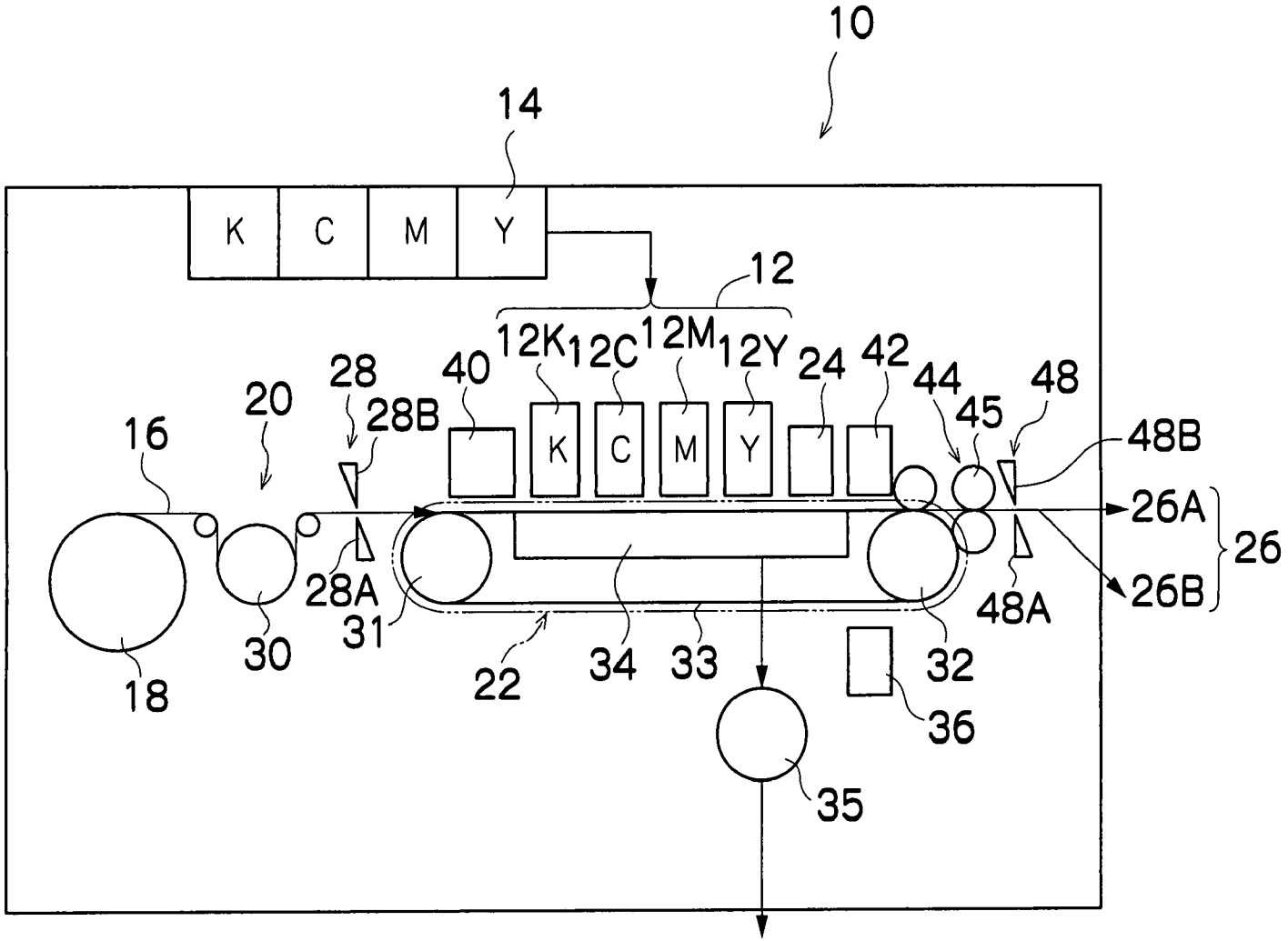
FIG. 1 is a general schematic drawing of an embodiment of an inkjet recording apparatus forming an image forming apparatus according to the present invention.

FIG. 1 is a general schematic drawing of an embodiment of an inkjet recording apparatus which forms an image forming apparatus relating to the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown in FIG. 1, but shown in FIG. 3) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
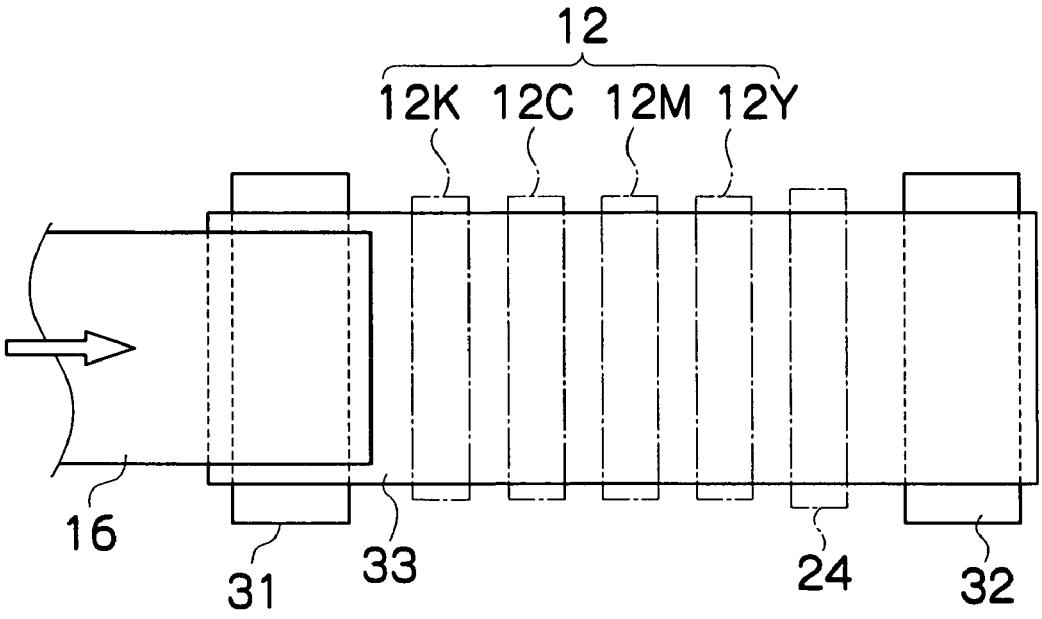
FIG. 2 is a plan view of the principal part of the peripheral area of a print unit in the inkjet recording apparatus illustrated in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y which constitute the print unit 12 each comprise line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

By adopting the printing unit 12 in which the full line heads covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which the print head reciprocates in a direction (the main scanning direction) perpendicular to the paper conveyance direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, 12Y, via a tube channel (not illustrated). Moreover, the ink storing and loading unit 14 also comprises a notifying device (display device, alarm generating device, or the like) for generating a notification if the remaining amount of ink has become low, as well as having a mechanism for preventing incorrect loading of the wrong colored ink.

The print determination unit 24 has an image sensor (a line sensor or the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed by the print heads 12K, 12C, 12M, and 12Y of the respective colors, and determines the ejection performed by each head. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Description of Control System

Figure 3:
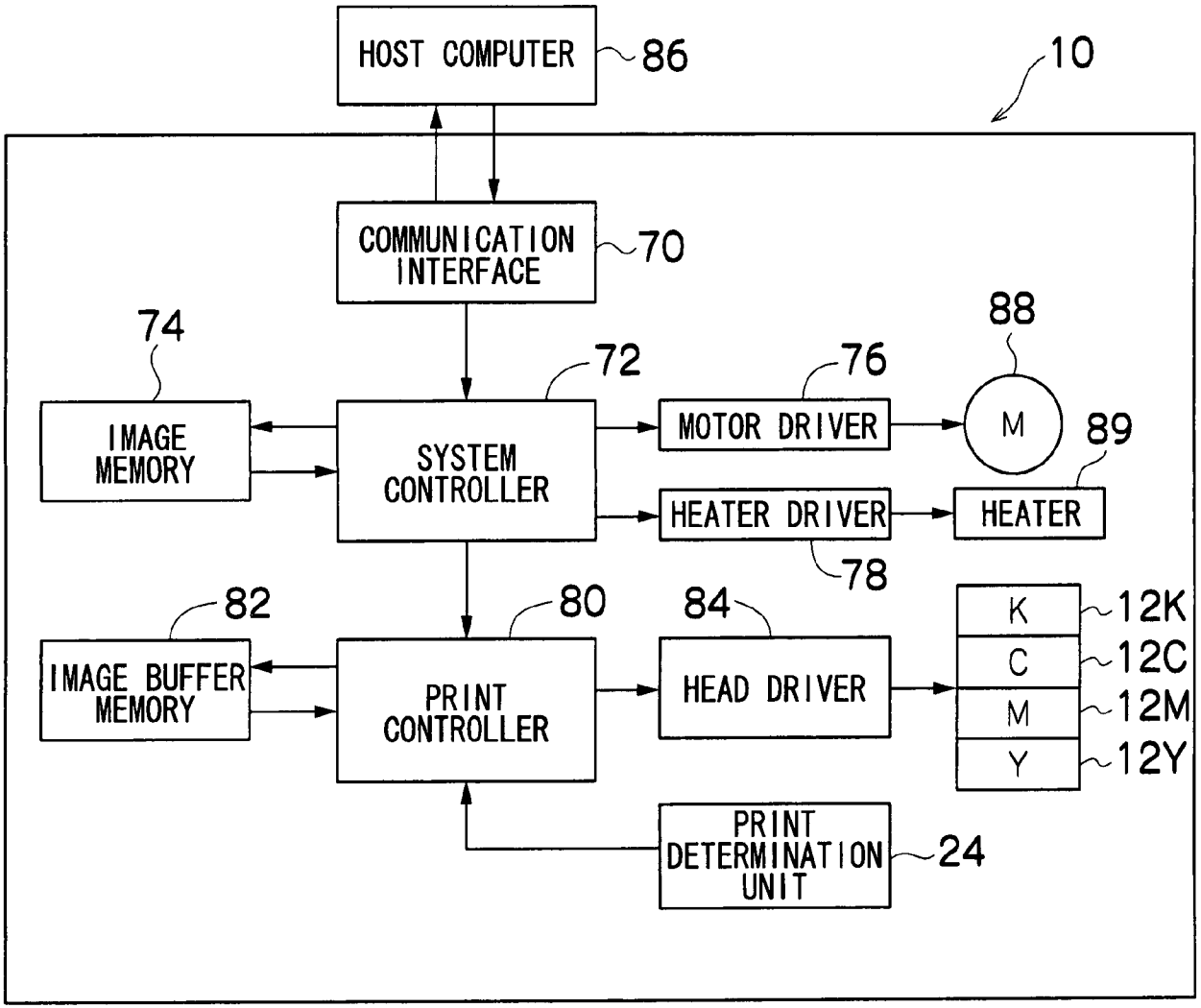
FIG. 3 is a principal block diagram showing the system composition of the inkjet recording apparatus.

FIG. 3 is a principal block diagram showing the system composition of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communications interface 70 is an interface unit for receiving image data transmitted by a host computer 86. For the communications interface 70, a serial interface, such as USB, IEEE 1394, the Internet, or a wireless network, or the like, or a parallel interface, such as a Centronics interface, or the like, can be used. It is also possible to install a buffer memory (not illustrated) for achieving high-speed communications. Image data sent from a host computer 86 is read into the inkjet recording apparatus 10 via the communications interface 70, and it is stored temporarily in the image memory 74. The image memory 74 is a storage device for temporarily storing an image input via the communications interface 70, and data is written to and read via the system controller 72. The image memory 74 is not limited to a memory formed of semiconductor elements, and a magnetic medium, such as a hard disk, or the like, may also be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 is a driver (drive circuit) which drives the motor 88 in accordance with instructions from the system controller 72. The heater driver 78 drives the heater 89 of the post-drying unit 42 or the like in accordance with commands from the system controller 72.

The print controller 80 is a control unit having a signal processing function for performing various treatment processes, corrections, and the like, in accordance with the control implemented by the system controller 72, in order to generate a signal for controlling printing from the image data in the image memory 74. The print controller 80 supplies the print control signal (image data) thus generated to the head driver 84. Prescribed signal processing is carried out in the print controller 80, and the ejection amount and the ejection timing of ink droplets from the print heads 12K, 12C, 12M and 12Y are controlled via the head driver 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. FIG. 3 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

The head driver 84 drives piezoelectric elements 58 (not shown in FIG. 3, but shown in FIG. 6) of the respective colors, 12K, 12C, 12M, 12Y, on the basis of print data supplied by the print controller 80. A feedback control system for maintaining constant drive conditions for the print heads may be included in the head driver 84.

As shown in FIG. 1, the print determination unit 24 is a block including a line sensor (not illustrated), which reads in the image printed onto the recording paper 16, performs various signal processing operations, and the like, and determines the print situation (presence/absence of ejection, variation in droplet ejection, and the like). The print determination unit 24 supplies these detection results to the print controller 80.

As and when necessary, the print controller 80 performs various corrections relating to the print heads 12K, 12C, 12M, 12Y, on the basis of the information obtained by the print determination unit 24.

Structure of Print Heads

Next, the structure of a print head 12K, 12C, 12M, 12Y will be described. The print heads 12K, 12C, 12M and 12Y of the respective ink colors have the same structure, and a reference numeral 50 is hereinafter designated to any of the print heads.

Figure 4:
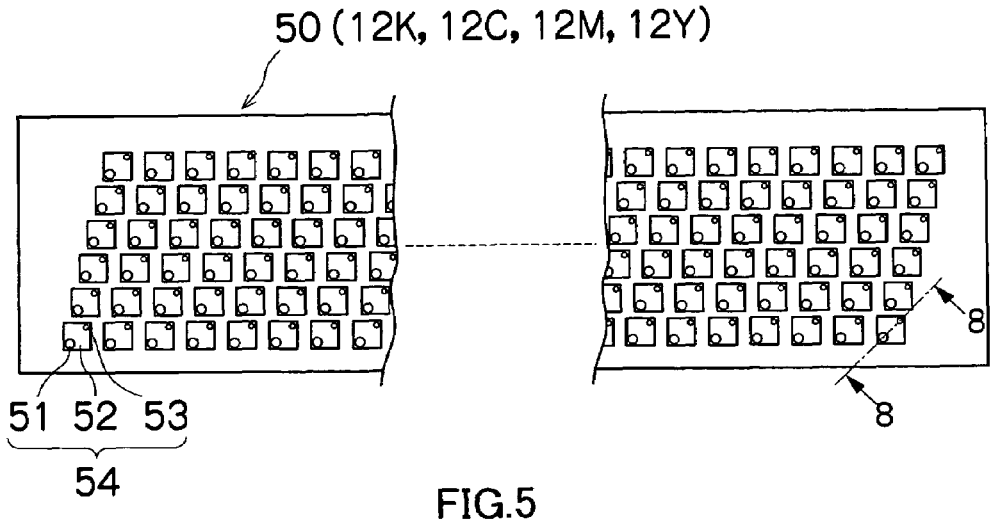
FIG. 4 is a plan perspective diagram showing an example of the structure of a print head.
Figure 5:
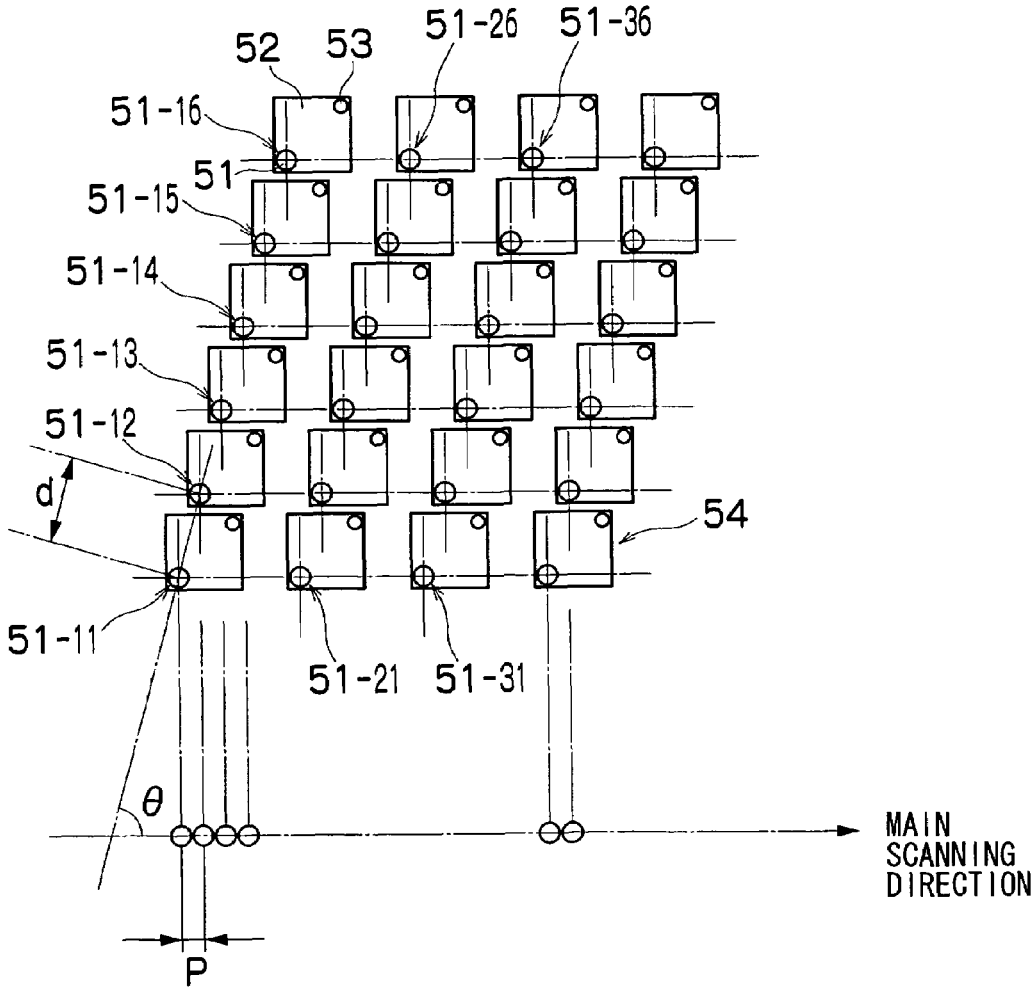
FIG. 5 is an enlarged view showing an example of the nozzle arrangement in the print head illustrated in FIG. 4.

FIG. 4 is a plan view perspective diagram showing an example of the structure of a print head 50, and FIG. 5 is an enlarged diagram showing a nozzle arrangement in the print head 50 shown in FIG. 4.

As shown in FIG. 4, the print head 50 achieves a high density arrangement of nozzles 51 by using a two-dimensional staggered matrix array of pressure chamber units 54, each constituted by a nozzle 51 for ejecting ink droplets, a pressure chamber 52 for applying pressure to the ink in order to eject ink, and an ink supply port 53 for supplying ink to the pressure chamber 52.

In the example shown in FIG. 4, the pressure chambers 52 each have an approximately square planar shape when viewed from above, but the planar shape of the pressure chambers 52 is not limited to a square shape, and it may also be a rectangular shape, a diamond shape, an oval shape, and the like. As shown in FIG. 4, a nozzle 51 is formed at one corner of a diagonal of each pressure chamber 52, and an ink supply port 53 is provided at the other corner thereof.

As shown in FIG. 5, the plurality of pressure chamber units 54 having the above-described structure are arranged in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction. By adopting a structure in which the pressure chamber unit 54 are arranged at a uniform pitch d in line with a direction forming an angle of $\theta$ with respect to the main scanning direction, the pitch P of the nozzles projected so as to align in the main scanning direction is $d \times \cos\theta$.

In other words, the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line or single strip in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

Figure 6:
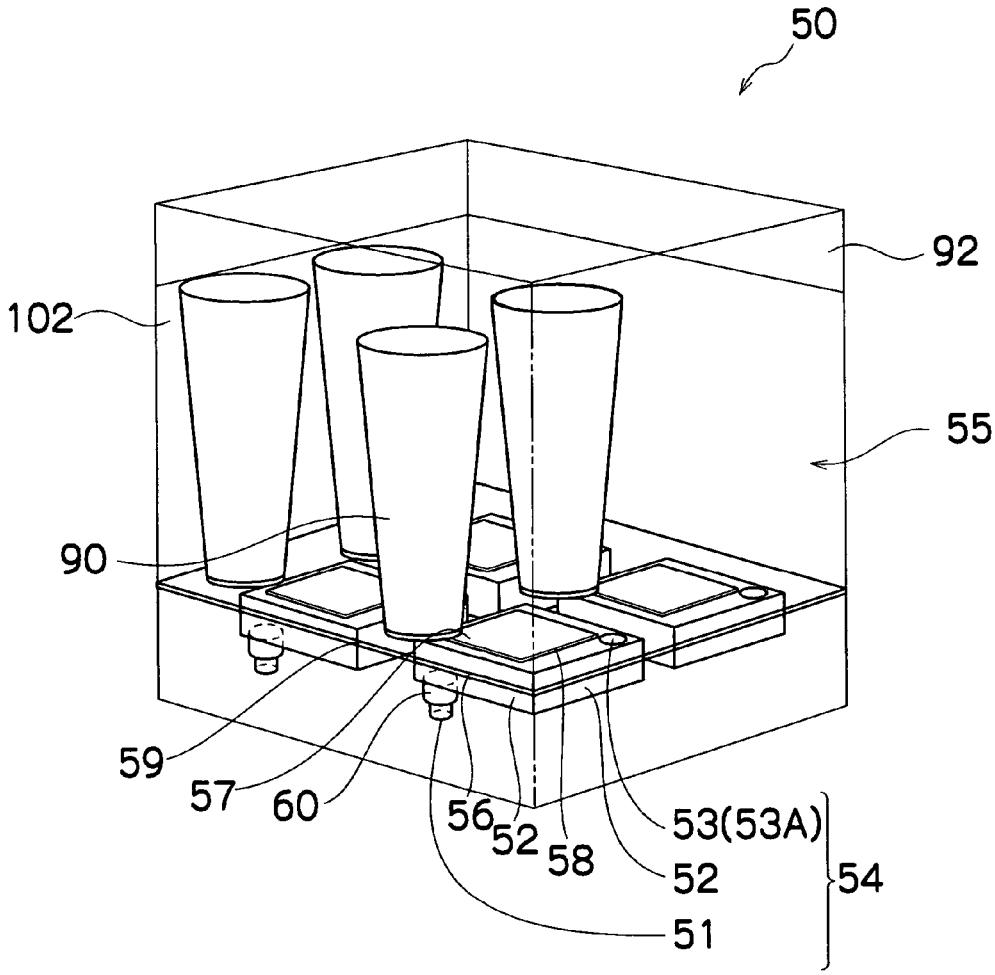
FIG. 6 is an oblique perspective diagram showing a portion of the approximate internal composition of the print head.

FIG. 6 is an oblique perspective diagram showing a portion of the approximate internal composition of the print head 50. In FIG. 6, four pressure chamber units 54 are depicted.

As shown in FIG. 6, the print head 50 comprises nozzles 51, pressure chambers 52 having a substantially cubic form, which are connected to the nozzles 51 via nozzle flow channels 60, and a common liquid chamber 55, which is connected to the pressure chambers 52.

The ceiling of the pressure chambers 52 is constituted by a diaphragm 56. Furthermore, piezoelectric elements 58 provided respectively with individual electrodes 57 are disposed on top on the diaphragm 56 in positions corresponding to the respective pressure chambers 52. In other words, piezoelectric elements 58 are provided on the diaphragm 56 on the opposite side to the side there the nozzles 51 of the pressure chambers 52 are formed. In the print head 50 shown in FIG. 6, the diaphragm 56 also forms a common electrode for the piezoelectric elements 58.

The lower portion of a wiring member 90 formed in the shape of a tapered column is bonded onto each piezoelectric element 58. The upper portion of each wiring member 90 is bonded to a flexible cable 92 which is connected to the head driver 84 (see FIG. 3). This wiring member 90 is constituted by a conductive member made of copper, or the like.

A composition is adopted in which one wiring member 90 is provided for each piezoelectric element 58, but the composition is not limited to this and it is also possible to provide one wiring member 90 for a plurality of piezoelectric elements 58. In this case, the number of piezoelectric element wires (electrical columns) 90 formed in the print head 50 can also be reduced.

A sealing member 102 for sealing the liquid in the common liquid chamber 55 is provided on the lower surface of the flexible cable 92. The sealing member 102 is constituted by a stainless steel member, or the like, for example. A protective film 103 (not shown in FIG. 6, but shown in FIGS. 8 and 9) and a resin coating 104 (not shown in FIG. 6, but shown in FIG. 9) are provided on the upper surface of the sealing member 102. The head driver 84 may be provided above the protective film 103 or the resin coating 104.

The common liquid chamber 55 is a space formed between the diaphragm 56 and the multi-layer flexible cable 92. The common liquid chamber 55 is formed as one large space in a region which covers all of the pressure chambers 52 shown in FIG. 4, and it stores ink to be supplied to the pressure chambers 52. The common liquid chamber 55 is not limited to this composition, and a plurality of spaces divided into several regions may be provided.

The wiring members 90 connecting the piezoelectric elements 58 and the flexible cables 92 are composed in such a manner that they pass through the ink stored in the common liquid chamber 55. Therefore, an insulating and protective film 98 is formed on the surfaces of the wiring members 90 which are made of conductive members. Due to their shape and function, the wiring members 90 may also be called "electrical columns".

Besides the surfaces of the wiring members 90, an insulating and protective film 98 is formed on the ink-contacting sections of the diaphragm 56, the piezoelectric elements 58 and the flexible cable 92 forming a portion of the walls of the common liquid chamber 55, and hence these sections also function as sealing plates for retaining the ink in the common liquid chamber 55.

An ink supply port 53 is formed between the common liquid chamber 55 and each of the pressure chambers 52, in such a manner that the common liquid chamber 55 is connected to each respective pressure chamber 52. In the print head 50 shown in FIG. 6, the ink supply port 53 is formed to a very fine size, and the hole diameter of the ink supply port 53 is smaller than the hole diameter of the nozzle 51. In this way, the fine ink supply port 53 (or a portion thereof) forms a supply restrictor 53A which creates a flow resistance. When an ink droplet is ejected from the nozzle 51, the supply restrictor 53A restricts reflux of ink from the pressure chamber 52 to the common liquid chamber 55, and thus stabilizes the ink ejection from the nozzle.

Next, the action of the print head 50 having the foregoing composition will be described.

The ink accumulated in the common liquid chamber 55 is supplied to the pressure chamber 52, via the ink supply port 53. When the head driver 84 (see FIG. 3) sends a drive signal to the piezoelectric element 58, that drive signal is supplied to the individual electrode 57 via the flexible cable 92 and the wiring member 90.

When the drive signal is supplied to the individual electrode 57, the piezoelectric element 58 deforms, and the diaphragm 56 which constitutes the ceiling of the pressure chamber 52 also deforms. Therefore, the volume of the pressure chamber 52 decreases, and the ink accumulated inside the pressure chamber 52 is ejected via the nozzle flow channel 51 and out from the nozzle 60, in the form of an ink droplet.

In the print head 50 shown in FIG. 6, a common liquid chamber 55 is provided on the opposite side of the pressure chamber 52 from the side where the nozzle 51 (ejection port) is formed, and a wiring member 90 connected to the individual electrode 57 of the piezoelectric element 58 on the diaphragm 56 is provided in such a manner that it passes through the common liquid chamber 55. Consequently, since electrical wiring space for the head driver 84 (see FIG. 3) and the flexible cable 92 connected to same can be ensured on the opposite side of the common liquid chamber 55 from the diaphragm 56, it is possible to adapt to increase in the electrical wiring due to increased density of the nozzles 51.

Furthermore, since the common liquid chamber 55 is disposed on the opposite side of the pressure chamber 52 from the side where the nozzles 51 (ejection port) is formed, then it is possible to form the common liquid chamber 55 to a larger size than in a case where it is disposed on the same side as the pressure chamber 52. Furthermore, the length of the nozzle flow channel 60 between the pressure chamber 52 and the nozzle 51 can be shortened in comparison to a case where the common liquid chamber 55 is provided on the same side as the pressure chamber 52. Moreover, there is no need for a complicated flow channel for guiding ink from the common liquid chamber 55 to the pressure chamber 52, and therefore, it is possible to connect the common liquid chamber 55 and the pressure chamber 52 directly. Consequently, ink of high viscosity can be ejected and furthermore, a rapid refilling operation after ejection becomes possible and high-frequency driving is possible.

There are no particular restrictions on the size of the print head 50 described above, but to give one example, the planar shape of the pressure chambers 52 is a square shape of 300 μm×300 μm, and the height of the pressure chambers is 150 μm, while the diaphragm 56 and the piezoelectric elements 58 each have a thickness of 10 μm, and the wiring members 90 have a diameter of 100 μm at the bonding section with the individual electrodes 57, and a height of 500 μm.

Method of Manufacturing Print Head

Next, a method of manufacturing a print head 50 of this kind will be described.

Figure 7:
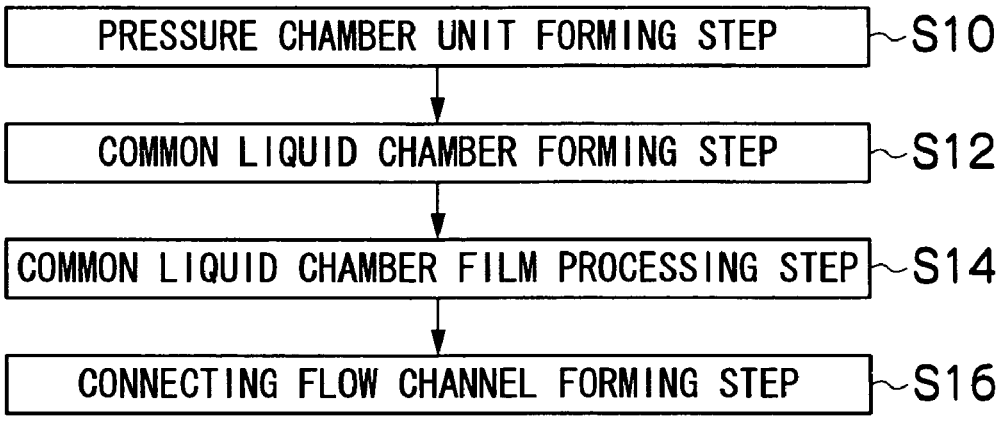
FIG. 7 is a flow diagram showing a sequence for the manufacture of a print head 50.

FIG. 7 is a flow diagram showing a sequence for the manufacture of a print head 50. As shown in FIG. 7, the print head 50 is manufactured by successively performing a pressure chamber unit forming step (S10), a common liquid chamber forming step (S12), a common liquid chamber film treatment step (S14) and a connection flow channel forming step (S16). These steps are described in detail below.

Figure 8:
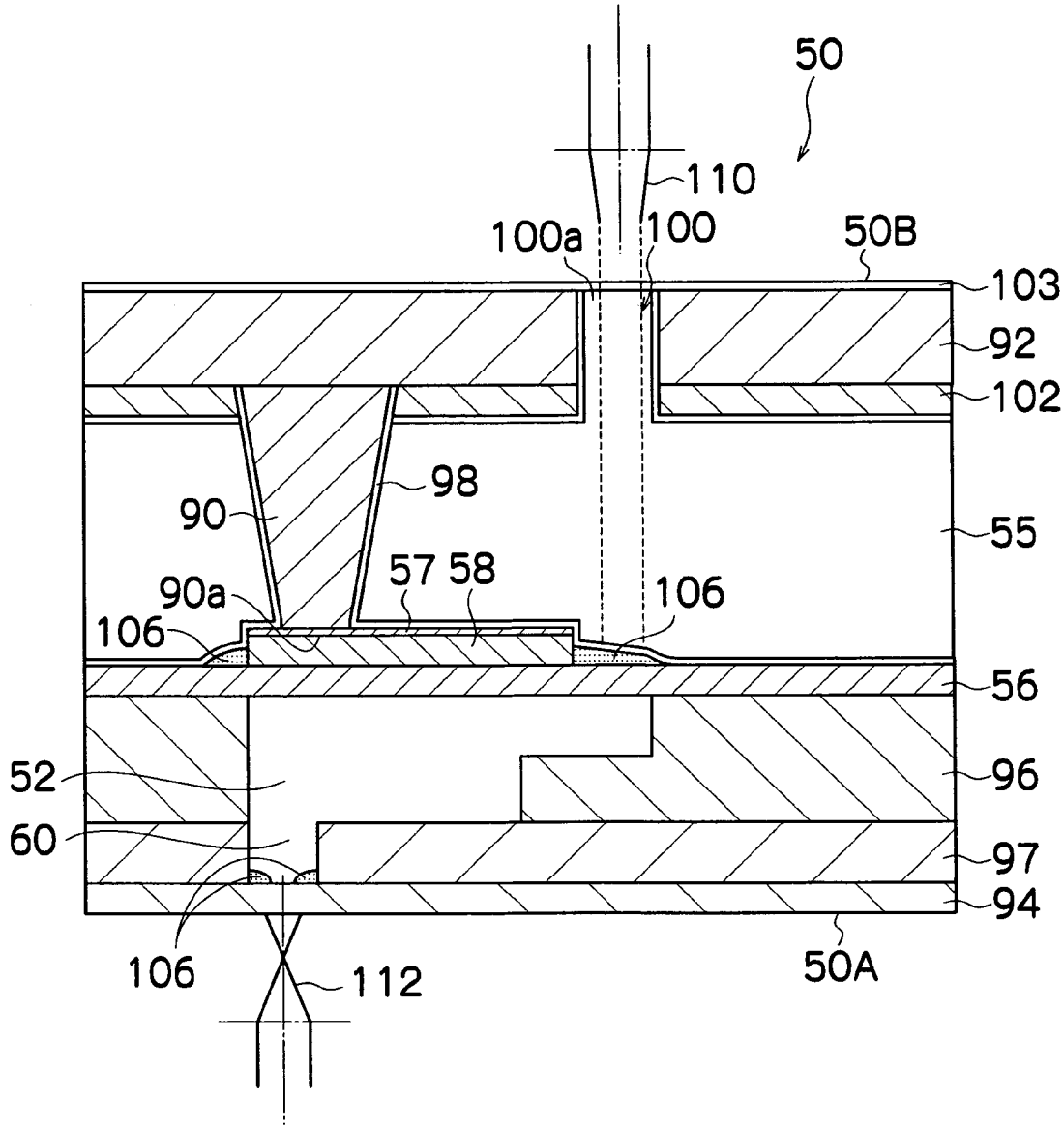
FIG. 8 is a cross-sectional diagram along line 8-8 in FIG. 4 showing a state prior to processing of the supply restrictors and nozzles.
Figure 9:
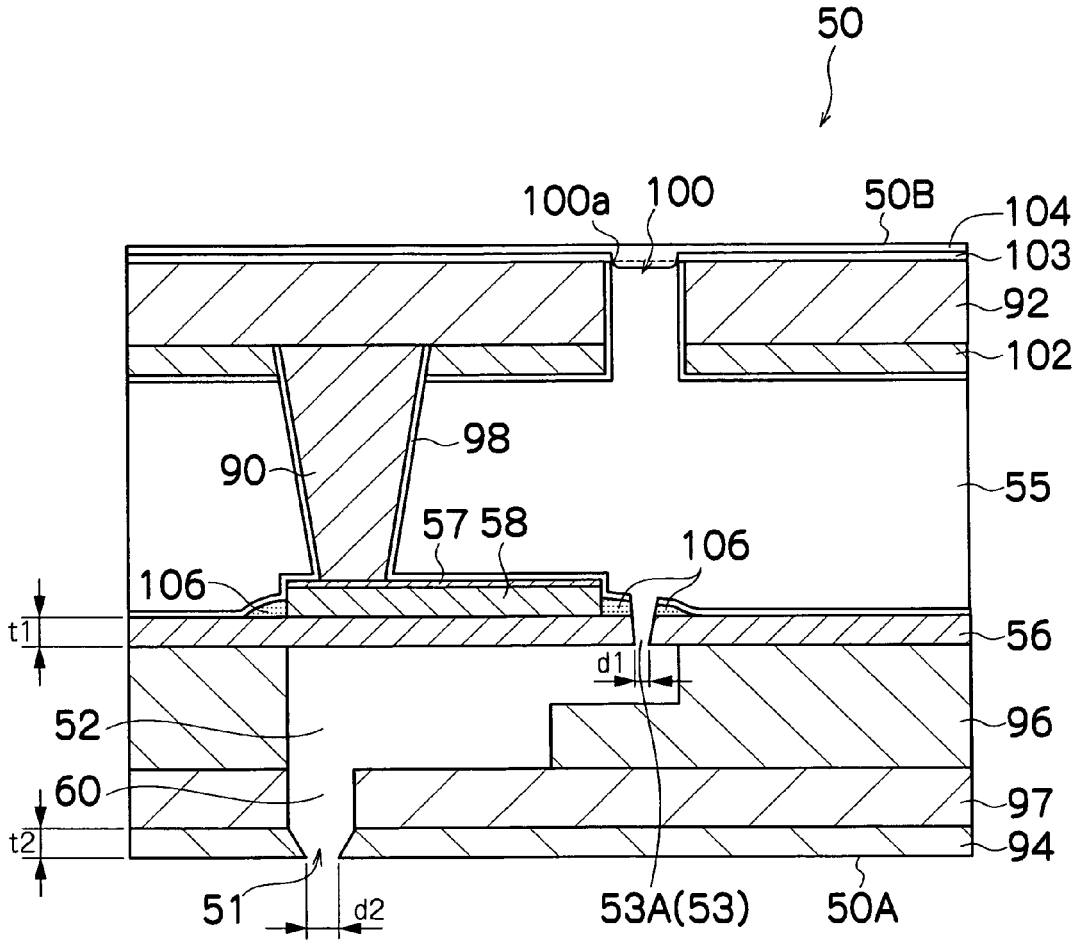
FIG. 9 is a cross-sectional diagram along line 8-8 in FIG. 4 showing a state after processing of the supply restrictors and nozzles.

FIG. 8 corresponds to the cross-sectional position 8-8 in FIG. 4, and provides a cross-sectional diagram showing a state prior to processing of the supply restrictor 53A and nozzle 51. FIG. 9 is a cross-sectional diagram along 8-8 in FIG. 4, after processing of the supply restrictor 53A and nozzle 51.

As shown in FIG. 8, a plurality of plate members in which a supply restrictor 53A and nozzle 51 have not yet been processed are bonded together in a laminated fashion, thereby assembling a print head 50. This step corresponds to the pressure chamber unit forming step (S10) indicated in FIG. 7.

On the upper surface (in terms of FIG. 8) of a nozzle plate 94 not yet formed with nozzles 51 are layered: a flow channel plate 97 already formed with nozzle flow channels 60, a pressure chamber plate 96 already formed with hole sections or groove sections constituting a portion of the pressure chambers 52, a diaphragm 56 not yet formed with ink restrictors 53A (ink supply ports 53) which constitutes the ceiling of the pressure chambers 52, and piezoelectric elements 58, these respective layers being bonded together by means of an adhesive or the like. The nozzle plate 94 and the diaphragm 56 are made of stainless steel.

When bonding these plates together, as shown in FIG. 8, surplus adhesive 106 may be expelled from the bonding section between the nozzle plate 94 and the flow channel plate 97, into the nozzle flow channel 60, and the surplus adhesive 106 may be expelled into the periphery of the bonding section between the diaphragm 56 and the piezoelectric element 58, becoming solidified in these positions. In FIG. 8, the surplus adhesive 106 in the other bonding sections is omitted from the drawing.

Next, in the common liquid chamber forming step (see FIG. 7), although not shown in the drawings, a copper layer is formed beneath a flexible cable 92 bonded to a sealing member 102 made of stainless steel, and wiring members 90 are formed by etching the copper layer. As shown in FIG. 8, each wiring member 90 is oriented downward in FIG. 8, and the front end section 90*a* of the wiring member 90 is bonded to the individual electrode 57 by means of a conductive adhesive or an anisotropic conductive film, or the like. An irradiation hole 100 which passes through the upper and lower surfaces of the sealing member 102 and the flexible cable 92 is processed by wet etching, or the like. Alternatively, the wiring member 90 may be formed by casting nickel on the flexible cable 92.

The irradiation hole 100 is formed in the sealing member 102 and the flexible cable 92 directly above the position at which a supply restrictor 53A is to be formed. In other words, the irradiation hole 100 is formed in such a manner that a laser beam 110 can be irradiated onto the formation position of the supply restrictor 53A, from the non-nozzle surface 50B of the print head 50 on the side opposite to the nozzle surface 50A. The irradiation hole 100 has a sufficiently small diameter, of the order of 100 μm to 200 μm, for example.

Figure 20:
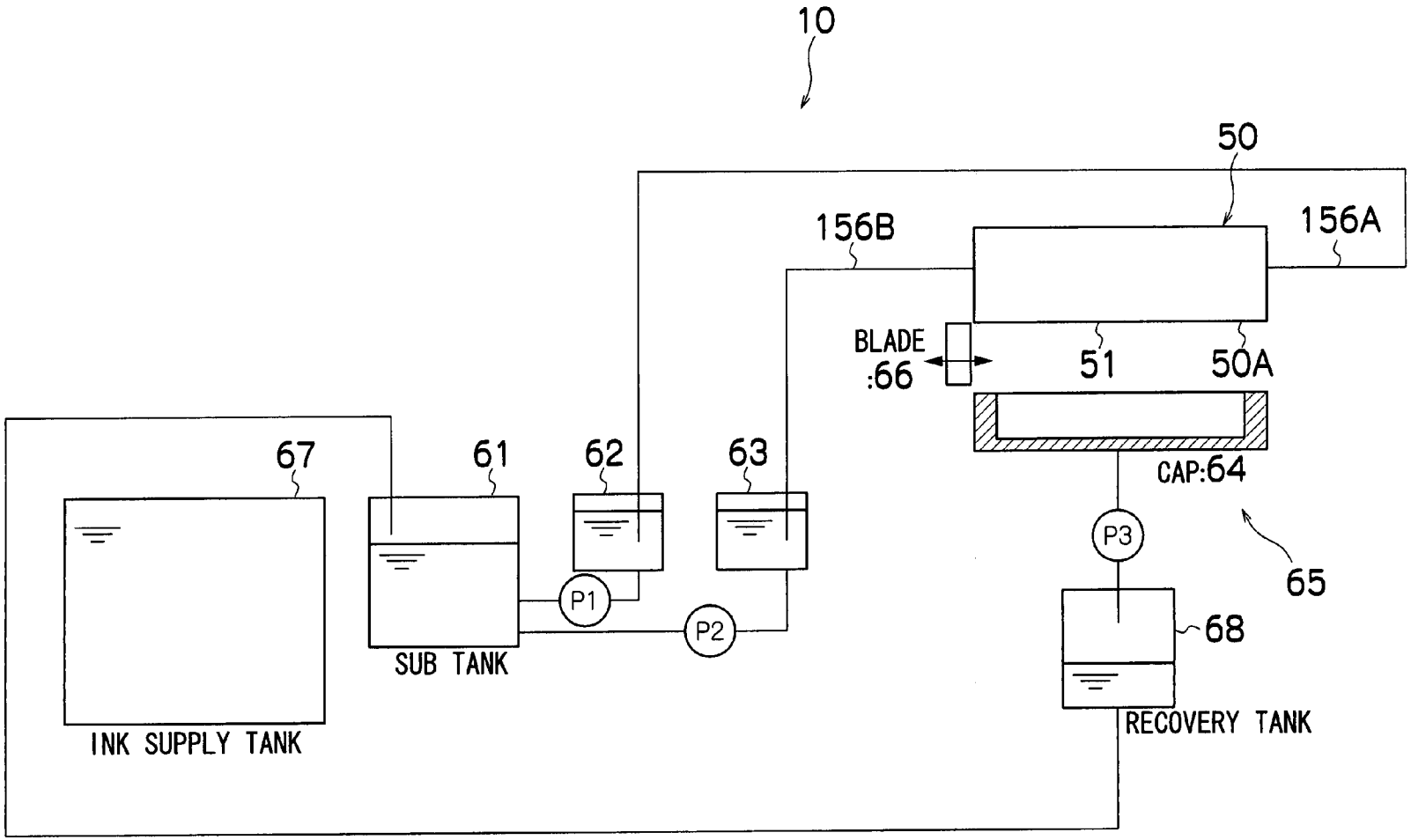
FIG. 20 is an approximate diagram showing the composition of an ink supply system in the inkjet recording apparatus.

Next, in the common liquid chamber film treatment step (see FIG. 7), an insulating coating resin is caused to flow into the common liquid chamber 55 from the ink supply tank 67 (not shown in FIG. 8, but shown in FIG. 20). Before introducing the insulating coating resin, a protective film 103 is applied to the upper surface of the sealing member 102, and the opening 100*a* of the irradiation hole 100 is sealed off by the protective film 103. The insulating coating resin which flows into the common liquid chamber 55 may be, for example, a liquid coating material, an electrolytic coating material, or a gaseous coating material.

Consequently, an insulating and protective film 98 is formed on the ink-contacting sections of the diaphragm 56, piezoelectric elements 58, and flexible cable 92, which form a portion of the walls of the common liquid chamber 55. In this case, the insulating and protective film 98 is also formed on the surface of the surplus adhesive 106 which arises when bonding the diaphragm 56 with the piezoelectric elements 58.

In this way, by introducing the insulating coating resin into the common liquid chamber 55, it is possible readily to implement an insulation treatment of the members constituting a portion of the walls of the common liquid chamber 55, such as the wiring members 90, piezoelectric elements 58, and the like.

Furthermore, when the insulating coating resin is introduced into the common liquid chamber 55, the supply restrictors 53A (ink supply ports 53) connecting the common liquid chamber 55 with the respective pressure chambers 52 have not yet been processed, and therefore, it is possible to prevent the insulating coating resin from becoming introduced into the pressure chambers 52.

Subsequently, in the connection flow channel formation step (see FIG. 7), a laser beam 110 is irradiated through the irradiation hole 100 from the non-nozzle surface 50B of the print head 50, thus processing a supply restrictor 53A in the diaphragm 56. in this case, the protective film 103 in the opening 100*a* is melted by the irradiated laser beam 110. If a protective film 103 is applied to the sealing member 102 by means of an adhesive having a weak bonding force, then after peeling off the protective film 102, the supply restrictor 53A can be processed by irradiating the laser beam 110.

The laser beam 110 used is a laser beam having characteristics suited to abrasion of the material of the diaphragm 56, such as an excimer laser, for example.

Due to the increase in output and reduction in cost of short-wave lasers, such as a UV-YAG laser, in recent years, and the dramatic progress in ultra-short pulse lasers, such as femto-second lasers, these lasers have become able to process metals, which are conventionally difficult to process, as well as being effective with respect to resin materials such as polyimide. A laser of this kind can be used in the present embodiment, which is effective in improving production yield and accuracy when manufacturing a print head 50 formed to a long length and having a large number of nozzles by means of a metal material.

The shape of the laser beam 110 is formed into a tapered shape which narrows in width along the irradiation direction (the downward direction in FIG. 8), at the formation position of the supply restrictor 53A on the diaphragm 56.

When the tapered laser beam 110 is irradiated onto the diaphragm 56 from the non-nozzle surface 50B of the print head 50, via the irradiation hole 100, a supply restrictor 53A is formed by abrasion of the insulating and protective film 98, the surplus adhesive 106 and the diaphragm 56, located in the direction of irradiation of the laser beam 110. The shape of the supply restrictor 53A depends on the shape of the laser beam 110, and as shown in FIG. 9, this is a tapered shape which narrows in width from the common liquid chamber 55 side toward the pressure chamber 52 side.

Next, as shown in FIG. 8, a laser beam 112 is irradiated on the formation position of the nozzle 51, from the nozzle surface 50A side of the print head 50, thereby opening a nozzle 51 in the nozzle plate 94.

Similarly to the laser beam 110, an excimer laser, or the like, is used for the laser beam 112. The laser beam 112 is formed into an inversely tapered shape which broadens in width in the direction of irradiation of the laser beam 112 (the upward direction in FIG. 8), at the formation position of the nozzle 51 on the nozzle plate 94. For the inversely tapered laser beam 112, an optical lens is disposed between a laser light source and the nozzle surface 50A, and the broadening light from the beam waist onward is used, as disclosed in Japanese Patent Application Publication No. 5-330064, for example.

When the inversely tapered laser beam 112 is irradiated onto the formation position of the nozzle 51 on the nozzle plate 94 from the nozzle surface 50A side of the print head 50, a nozzle 51 is formed by abrasion. The shape of the nozzle 51 depends on the shape of the laser beam 112, and as shown in FIG. 9, this is a tapered shape which broadens in width from the nozzle surface 50A side toward the pressure chamber 52 side.

After forming the supply restrictor 53A and nozzle 51, as shown in FIG. 9, the surface of the protective film 103 (or the surface of the sealing member 102 if the protective film 103 is peeled away) is coated with the resin coating 104 of silicone, or the like. Since the diameter of the irradiation hole 100 is sufficiently small, the opening 100*a* is sealed by the resin coating 104. Moreover, a head driver 84 is provided on the surface of the resin coating 104.

In this way, after assembling the print head 50, in other words, after laminating and bonding together the plurality of plate members by means of adhesive or the like, and then implementing an insulating treatment with respect to the common liquid chamber 55, supply restrictors 53A and nozzles 51 are processed by irradiating a laser beam from the nozzle surface 50A side and the non-nozzle surface 50B side of the print head 50, and hence it is possible to achieve high accuracy of the supply restrictors 53A and the nozzles 51, and furthermore, blocking of the supply restrictors 53A or nozzles 51 by the surplus adhesive 106 or insulating coating resin, can be prevented.

Furthermore, the diaphragm 56 formed with the supply restrictors 53A and the nozzle plate 94 formed with nozzles 51 are both made from stainless steel members. By using substantially the same material for the plate members which are respectively formed with supply restrictors 53A and nozzles 51 in this way, it is possible to stabilize and optimize processing yet further, and moreover, warping of the flow channels in the print head 50 due to temperature variations can also be reduced. For these materials, polyimide, cast nickel, or the like, can be used rather than stainless steel described with reference to FIGS. 8 and 9. Concerning the term "substantially the same material", it is sufficient that the members made of "substantially the same material" are actually made of the materials that include the same major composition, and the members are not necessarily made of the identical material denoted with the same reference number, such as SUS304, SUS316 or SUS430 for stainless steal materials, for example. It is similar with respect to polyimide, cast nickel, or the like.

Here, as shown in FIG. 9, taking the hole diameter of the supply restrictor 53A to be d1, and taking the thickness of the diaphragm 56 to be t1, then the flow channel loss K1 of the supply restrictor 53A is represented as:

$$K1 \propto \frac{t1}{d1^4}. \tag{1}$$

Similarly, if the hole diameter of the nozzle 51 is taken to be d2 and the thickness of the nozzle plate 94 is taken to be t2, the flow channel loss K2 of the nozzle 51 is represented as:

$$K2 \propto \frac{t2}{d2^4}. \tag{2}$$

The print head 50 according to the present embodiment is composed in such a manner that the flow channel losses K1 and K2 in the supply restrictor 53A and the nozzle 51, which are connected to the pressure chambers 52, satisfy the following relationship (3):

$$\frac{t1}{d1^4} \approx \frac{t2}{d2^4}. \tag{3}$$

More specifically, in each of the pressure chambers 52, the ratio between the flow channel loss K1 of the supply restrictor 53A and the flow channel loss K2 of the nozzle 51 (pressure loss ratio) is designed to be approximately 1:1. The pressure loss ratio of this kind can be made uniform as described above, by adjusting the thickness t1 of the diaphragm 56, the thickness t2 of the nozzle plate 94, the laser output, and the like. For example, if the hole diameter d1 of the supply restrictor 53A is smaller than the hole diameter of the nozzle 51, then if the pressure loss ratio is to be set to 1:1, the thickness t1 of the diaphragm 56 should be adjusted so as to be greater than the thickness t2 of the nozzle plate 94.

By standardizing the pressure loss ratio among the pressure chambers 52 in this way and thus stabilizing the pressure loss balance, the ejected ink volume from the nozzles 51 is stabilized and high image quality can be achieved in an inkjet recording apparatus 10 comprising a print head 50 of this kind. The method for stabilizing the pressure loss balance among the pressure chambers 52 is described below.

Figure 10:
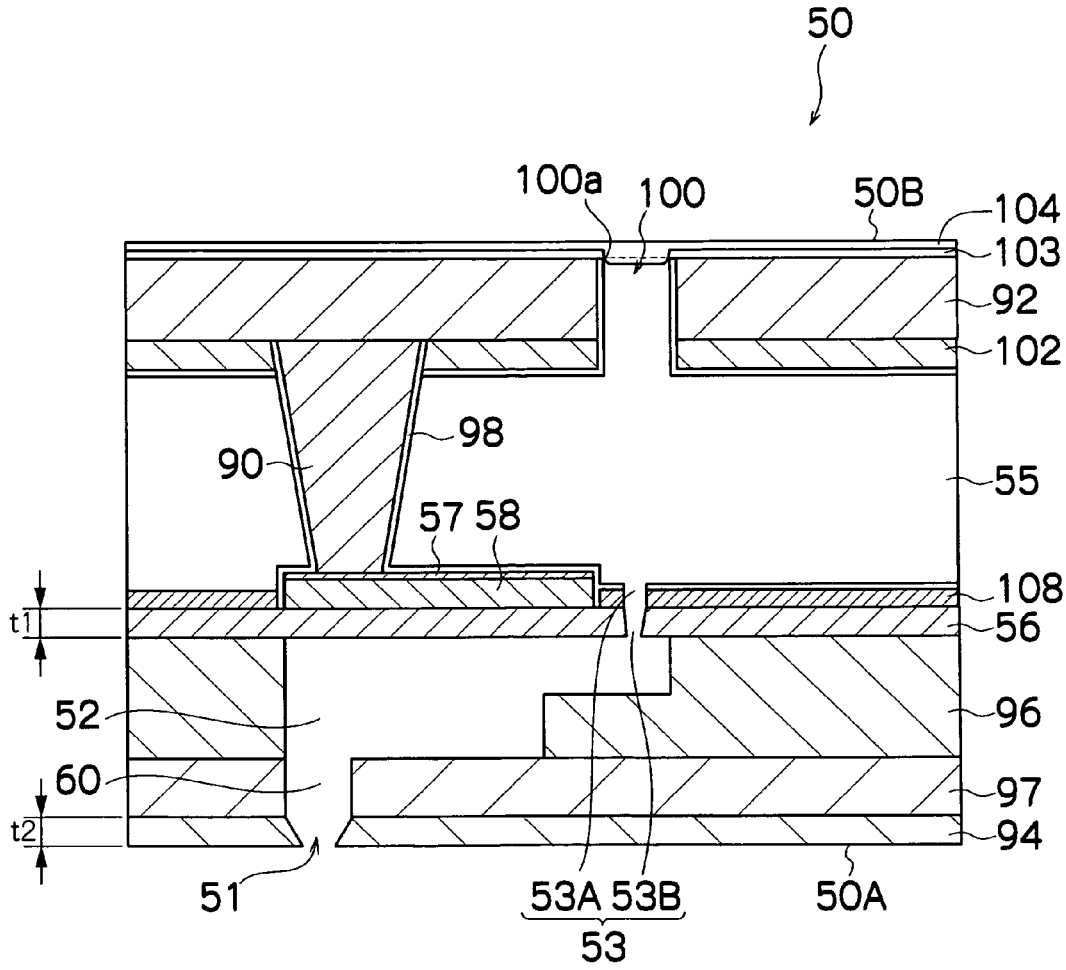
FIG. 10 is a cross-sectional diagram along line 8-8 in FIG. 4 showing a further example of the composition of the print head 50.

FIG. 10 shows a further example of the composition of the print head 50, being a cross-sectional diagram corresponding to the section 8-8 in FIG. 4. As shown in FIG. 10, the ink supply port 53 connecting the common liquid chamber 55 with the pressure chamber 52 is constituted by a fine supply restrictor 53A formed in a restrictor plate 108 laminated onto a diaphragm 56, and a through hole 53B formed in the diaphragm 56.

In the print head 50 shown in FIG. 10, the restrictor plate 108 and the nozzle plate 94 are made from the same material, polyimide, and as described above, stabilization and optimization of processing can be achieved, and warping of the flow channels inside the print head 50 due to temperature variations can be reduced.

Furthermore, similarly to the print head 50 shown in FIG. 8 and FIG. 9, the supply restrictors 53A and nozzles 51 are processed by laser beam after laminating together the respective plate members to assemble a print head 50. Therefore, it is possible to prevent blockages of the supply restrictors 53A, and furthermore, it is also possible to process the supply restrictors 53A and nozzles 51 to a high degree of accuracy.

Method for Stabilizing Pressure Loss Balance Among Pressure Chambers

Next, the method for stabilizing the pressure loss balance among the pressure chambers 52 is described.

Figure 11:
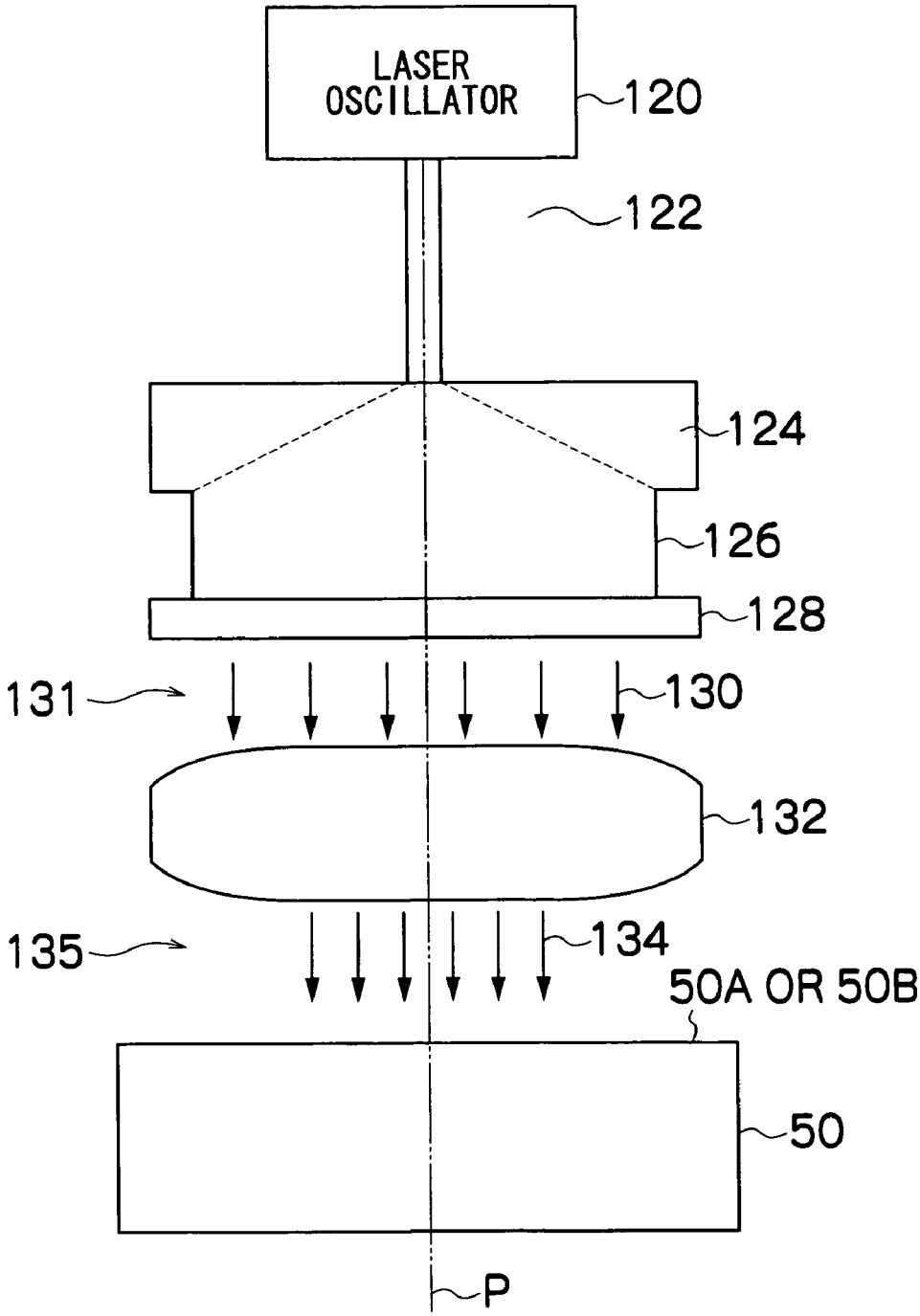
FIG. 11 is an illustrative diagram showing an approximate illustration of a method for processing supply restrictors and nozzles.

FIG. 11 is an illustrative diagram showing an approximate view of a method for processing supply restrictors 53A and nozzles 51. As shown in FIG. 11, a beam expander 124, mask 128, telecentric lens system 132 and print head 50 are disposed sequentially from the side adjacent to a laser oscillator 120, such as excimer laser, in the direction of irradiation of the laser beam 122 irradiated from the laser oscillator 120 (the downward direction in FIG. 11).

The beam expander 124 expands the laser beam 122 irradiated from the laser oscillator 120, in such a manner that it corresponds to the shape of the mask 126 disposed on the downstream side in the direction of irradiation of the laser beam 122. The expanding laser beam 126 is irradiated onto the mask 128.

Figure 12:
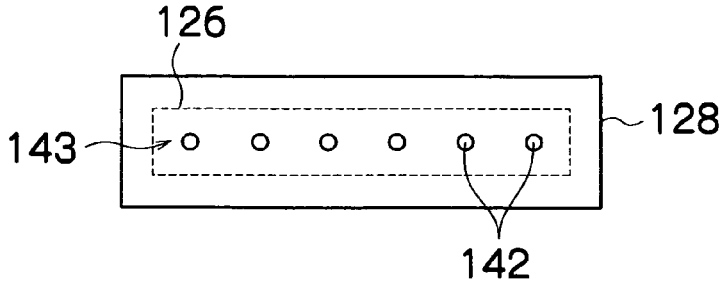
FIG. 12 is a plan diagram of the mask illustrated in FIG. 11.

FIG. 12 is a plan diagram of the mask 126 shown in FIG. 11. As shown in FIG. 12, a plurality of approximately circular openings 142, 142, . . . are arranged in the lengthwise direction of the mask 128 (below, this arrangement is called the row of openings 143). The range of irradiation of the expanding laser beam 126 irradiated onto the mask 128 (see FIG. 11) is designed in such a manner that it coincides with the region enclosed by the broken line in FIG. 12.

In FIG. 11, by passing the expanding laser beam 126 through the mask 128 comprising the row of openings 143 as described above, a rows of beams 131 is obtained comprising a plurality of beams 130, 130, . . . , corresponding to the shape of the openings 142. This row of beams 131 is parallel to the optical axis and is irradiated onto the telecentric lens system 132.

The telecentric lens system 132 maintains the parallelism of the input beams 130 with respect to the optical axis P, and projects the beams 130 at a condensed size on the basis of a prescribed factor of reduction, in such a manner that a row of condensed laser beams 135 including condensed laser beams 134, 134, . . . is emitted.

By maintaining the parallelism of the condensed laser beams 134 with respect to the optical axis P, it is possible to irradiate laser beams 110, 112 (see FIG. 8) in a substantially perpendicular direction with respect to the non-nozzle surface 50B or the nozzle surface 50A of the print head 50, and hence high-accuracy processing free of disparities in hole diameter, hole pitch and the like, can be achieved.

Furthermore, the reduction factor of the telecentric lens system 132 is determined by the shape of the row of the openings 143 in the mask 128 and the shape of the supply restrictors 53A or nozzles 51 to be formed on the print head 50.

When forming a plurality of supply restrictors 53A in the print head 50, a row of condensed laser beams 135 emitted from the telecentric lens system 132 is irradiated onto the non-nozzle surface 50B of the print head 50. The position of the diaphragm 56 and the pulse intensity during processing are adjusted in such a manner that the condensed laser beams 134 forming the row of condensed laser beams 135 form a forward tapered shape having a narrowing width in the direction of irradiation, at the formation positions of the supply restrictor 53A on the diaphragm 56.

The shape of the supply restrictors 53A formed by this row of condensed laser beams 135 is a tapered shape which narrows in width from the side of the common liquid chamber 55 to the pressure chamber 52 side, as shown in FIG. 9.

When forming a plurality of nozzles 51 in the print head 50, a row of condensed laser beams 135 emitted from the telecentric lens system 132 is irradiated onto the nozzle surface 50A of the print head 50. The position with respect to the rows of condensed laser beams 135 and the nozzle plate 94, and the pulse intensity during processing are adjusted in such a manner that the condensed laser beams 134 forming the row of condensed laser beams 135 form an inversely tapered shape having a broadening width in the direction of irradiation, at the formation positions of the nozzles 51 on the diaphragm 94.

Figure 13A:
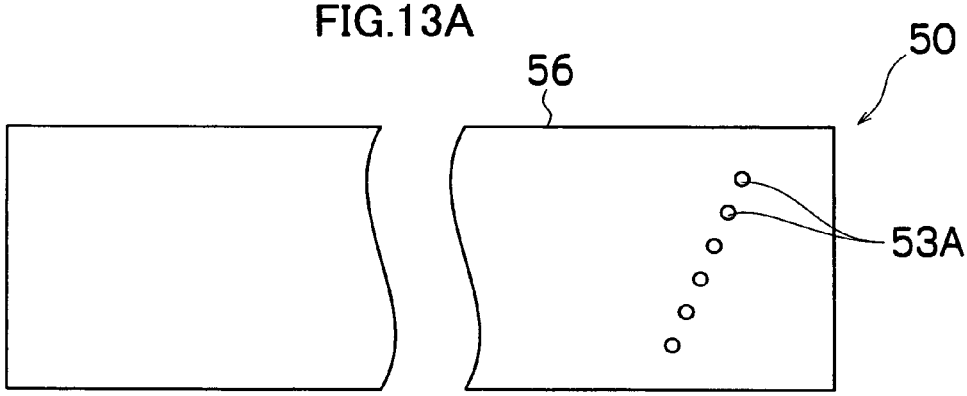
FIGS. 13A and 13B are plan diagrams of a vibration plate in which supply restrictors are formed by means of the processing method shown in FIG. 11.
Figure 13B:
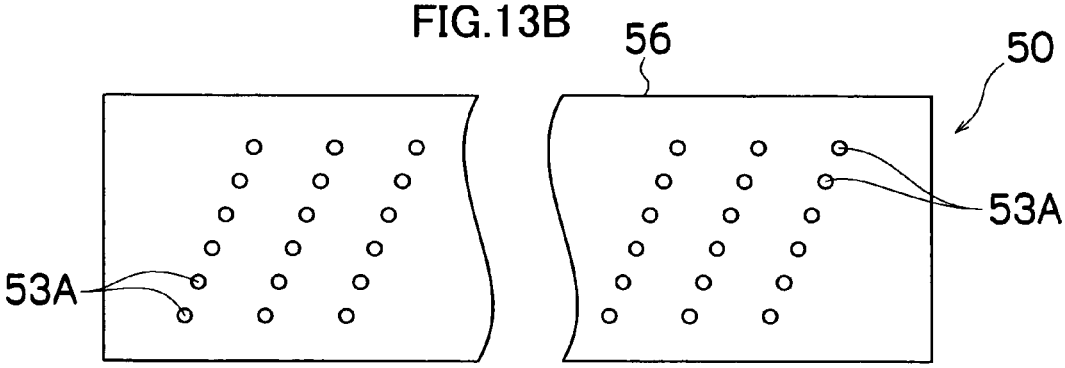

FIGS. 13A and 13B are plan diagrams of a diaphragm 56 in which an arrangement of supply restrictors 53A has been formed by means of the processing method shown in FIG. 11. FIG. 13A shows a state where an arrangement of supply restrictors 53A has been processed initially, and FIG. 13B shows a state where all of the supply restrictors 53A have been processed in a matrix shape. As described above, the supply restrictors 53A formed in the diaphragm 56 are formed by irradiating a laser beam from the non-nozzle surface 50B of the print head 50, after assembling the print head 50.

By means of the processing method shown in FIG. 11, when a row of condensed laser beams 135 is irradiated onto the non-nozzle surface 50B of the print head 50, in a substantially oblique direction with respect to the lengthwise direction of the print head 50, then as shown in FIG. 13A, a plurality of supply restrictors 53A arranged in a substantially oblique direction with respect to the lengthwise direction are formed in the diaphragm 56, at the same time. The shape of the plurality of supply restrictors 53A arranged in this manner is similar to the shape of the row of openings 143 in the mask 128.

Subsequently, the irradiation position of the row of condensed laser beams 135 is moved through a short distance in parallel with the lengthwise direction of the diaphragm 56 (the print head 50) and a row of condensed laser beams 135 is irradiated similarly to the first operation, thereby forming a plurality of supply restrictors 53A on the diaphragm 56 arranged in a substantially oblique direction with respect to the lengthwise direction. When this operation is repeated a number of times, supply restrictors 53A arranged in a matrix configuration are formed on the diaphragm 56 as shown in FIG. 13B.

It is also possible to change the relative irradiation positions of the row of condensed laser beams 135, by moving the print head 50 (diaphragm 56) through a small distance in parallel with the lengthwise direction, without moving the irradiation position of the row of condensed beams 135.

Figure 14:
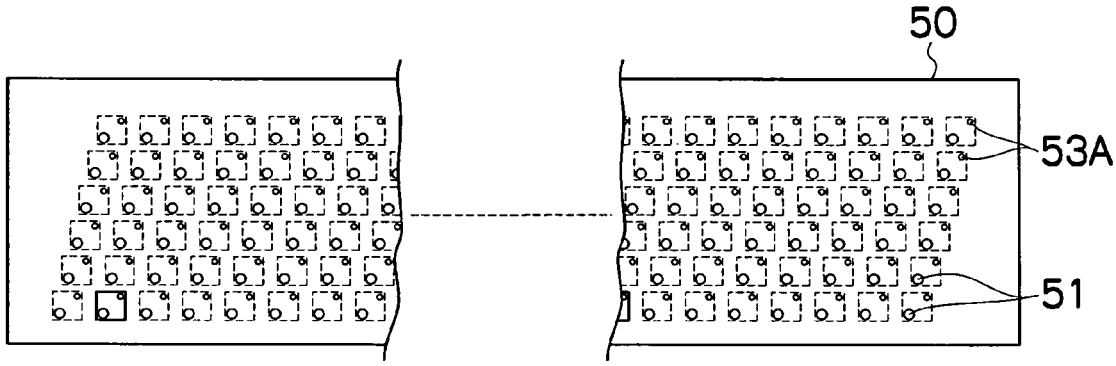
FIG. 14 is a plan view perspective diagram of a print head in which supply restrictors and nozzles have been formed by the processing method shown in FIG. 11.

FIG. 14 is a plan view perspective diagram of a print head 50 in which supply restrictors 53A and nozzles 51 have been processed in a matrix fashion by means of the processing method shown in FIG. 11.

Following the state in which supply restrictors 53A have been processed in a matrix fashion by the row of condensed laser beams 135 (see FIG. 13B), nozzles 51 are processed in a matrix fashion by using the same row of condensed laser beams 135 employed in the processing of the supply restrictors 53A, as shown in FIG. 14.

In the example shown in FIG. 14, the hole diameter of the nozzles 51 is formed to a greater size than the hole diameter of the supply restrictors 53A. By moving the position of the telecentric lens system 132 in the irradiation direction shown in FIG. 11 and adjusting the intensity of the laser, it is possible to form the nozzles 51 to a larger hole diameter than the supply restrictors 53A, while using the same row of condensed laser beams 135.

Between the laser oscillator 120 and the print head 50, there exist factors which cause variations in the condensed laser beams 134 (see FIG. 11) that constitute the row of condensed laser beams 135. For example, the laser beam 122 irradiated from the laser oscillator 120 may not be uniform, or there may be variations among the openings 142 formed in the mask 128. There may also be cases where variations occur in the hole diameter and the pitch (the distance between the centers of the holes) of the plurality of supply restrictors 53A or nozzles 51 formed by the row of condensed laser beams 135.

However, in the present embodiment, as shown in FIG. 14, a plurality of supply restrictors 53A and a plurality of nozzles 51 arranged respectively in an oblique direction with respect to the lengthwise direction of the print head 50 are processed by means of the same row of condensed laser beams 135, and therefore, the supply restrictors 53A and the nozzles 51 connected via the pressure chambers 52 are processed by the same condensed laser beams 134. Consequently, the ratios between the hole diameters of the supply restrictors 53A and nozzles 51 connected via the pressure chambers 52 are substantially uniform among the pressure chambers 52. In particular, if the supply restrictors 53A and the nozzles 51 are made of the same material, processing conditions are stabilized and further beneficial effects can be expected.

For example, if the diameter of a particular condensed laser beam 134 of the row of condensed laser beams 135 is 1% larger than the other condensed laser beam, then the diameter of the supply restrictor 53A and nozzle 51 formed by this condensed laser beam 134 will be approximately 1% larger than the diameters of the other supply restrictors 53A and nozzles 51. However, the ratio between the hole diameters of the supply restrictor 53A and nozzle 51 will be the same as the ratio between the hole diameters of the supply restrictors 53A and nozzles 51 formed by the other condensed laser beams 134.

In this way, even if there are variations in the row of condensed laser beams 135, since the supply restrictors 53A and nozzles 51 which are connected via the pressure chambers 52 are processed by the same condensed laser beam 134, the ratio between the hole diameters of the supply restrictor 53A and the nozzle 51 is substantially uniform in all of the pressure chambers 52, and consequently, the pressure loss ratio is substantially the same in all of the pressure chambers 52 and therefore the pressure balance is stabilized. Accordingly, the ejected ink volume from the nozzles 51 is stabilized and therefore, it is possible to achieve high image quality in an inkjet recording apparatus 10 provided with a print head 50 of this kind.

It is also possible further to reduce variations, by carrying out trimming by means of a single laser beam, or the like, where necessary, after processing the supply restrictors 53A and the nozzles 51 by means of the laser beam row.

Figure 15:
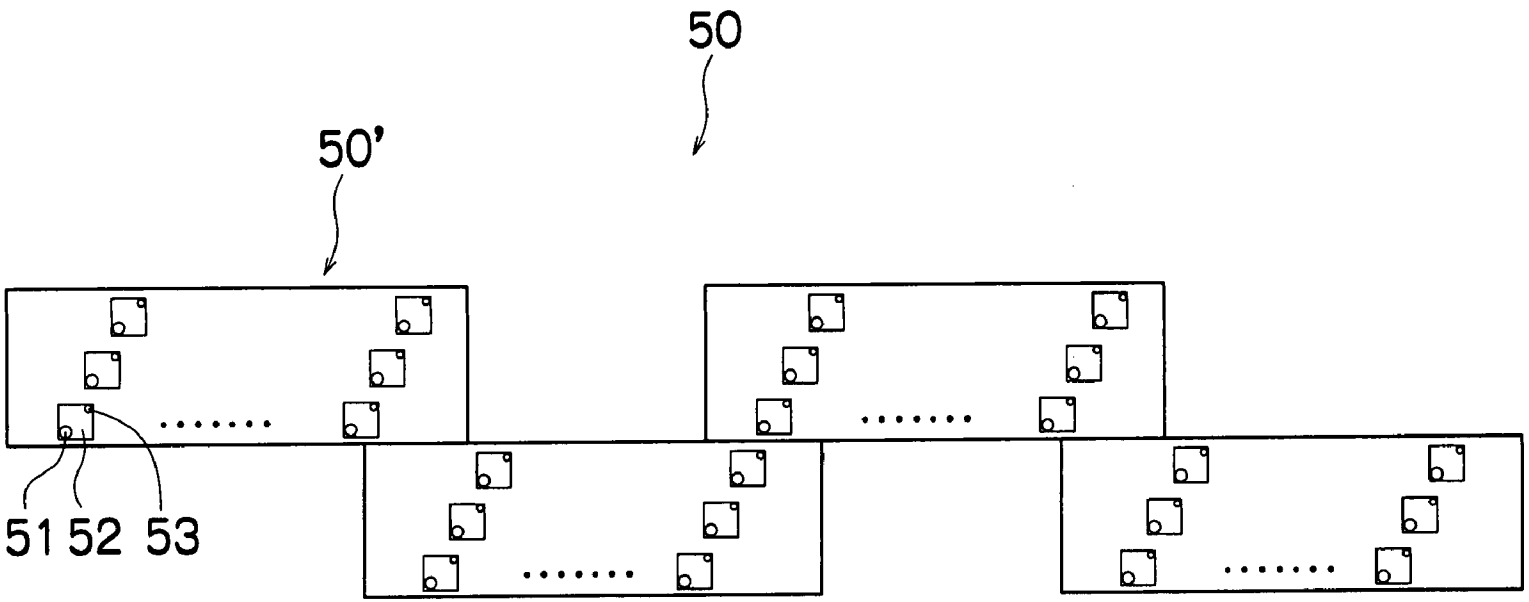
FIG. 15 is a plan view perspective diagram showing a further example of the structure of a print head.

FIG. 15 is a plan view perspective diagram showing a further example of the structure of a print head 50. The print head 50 shown in FIG. 15 is a full line head having a nozzle row of a length corresponding to the full width of the recording paper 16, achieved by joining together, in a staggered matrix, a plurality of short heads 50' each having a plurality of nozzles 51 arranged in a matrix array.

In the case of a print head 50 of this kind, desirably, the short heads 50' are assembled respectively, and are then arranged in a staggered matrix and joined together to form a full line type print head 50, whereupon the supply restrictors 53A and the nozzles 51 are processed.

The print head 50 formed of the joined short heads 50' is mounted on an X-Y stage, or the like, and similarly to the processing method shown in FIG. 11, a row of condensed laser beams 135 (see FIG. 11) is irradiated onto each of the short heads 50', thereby enabling supply restrictors 53A and nozzles 51 to be processed to a high degree of accuracy, while stabilizing the pressure loss balance among the pressure chambers.

If the short heads 50' are joined together after processing the supply restrictors 53A and the nozzles 51, positional displacement is liable to occur, whereas, if the supply restrictors 53A and the nozzles 51 are processed using an X-Y stage with respect to a print head 50 in which the short heads 50' have been joined together, the accurate positioning can be achieved. For example, the supply restrictors 53A and the nozzles 51 can be processed to a positional accuracy of 1 μm or less.

Figure 16:
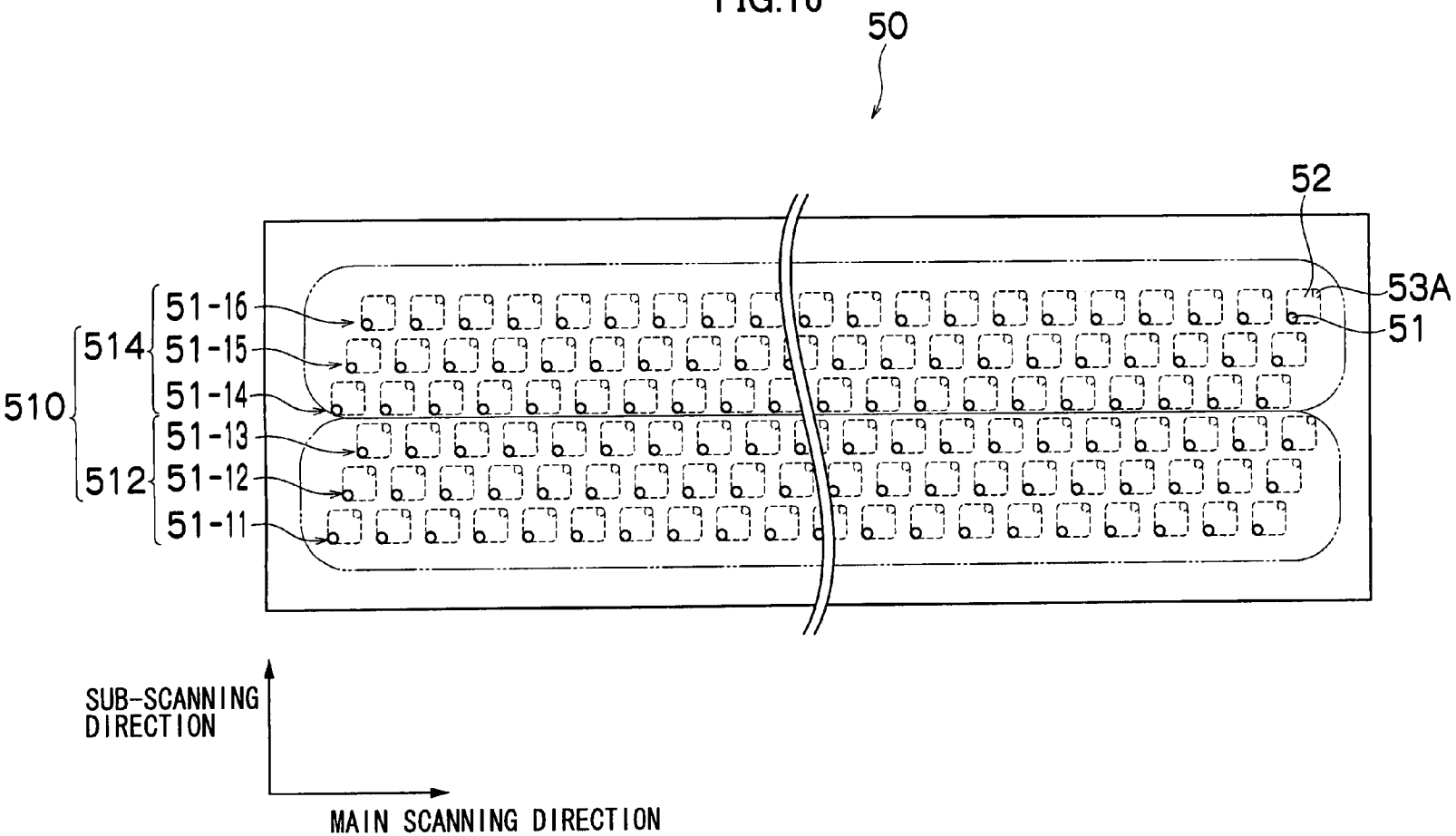
FIG. 16 is a plan view perspective diagram showing a further example of the structure of a print head.
Figure 17:
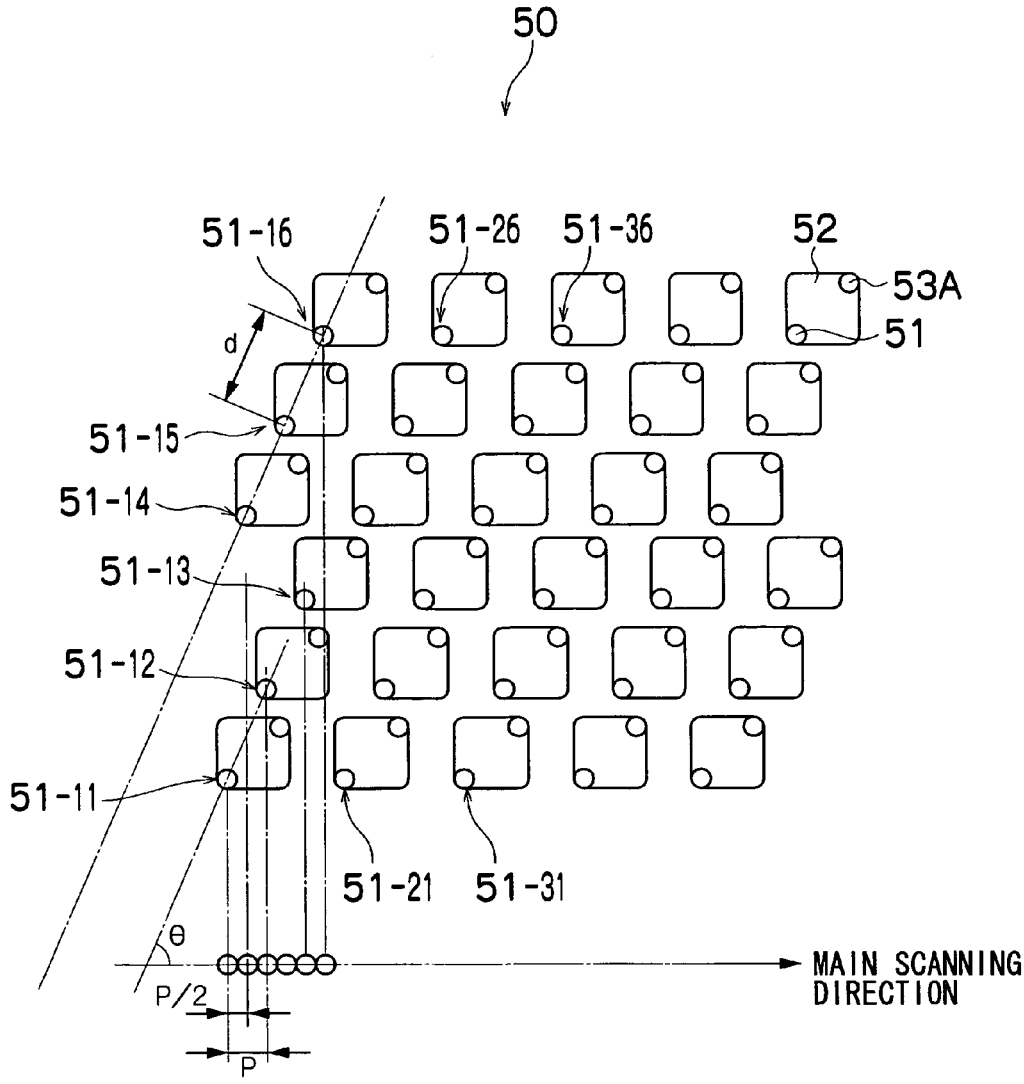
FIG. 17 is an enlarged view showing an example of the nozzle arrangement in the print head illustrated in FIG. 16.

FIG. 16 is a plan view perspective diagram showing a further example of the structure of a print head 50. FIG. 17 is an enlarged view showing an example of the nozzle arrangement in the print head 50 shown in FIG. 16.

In the print head 50 shown in FIG. 16 and FIG. 17, droplets are ejected according to a prescribed sequence (droplet ejection timings), in accordance with the conveyance speed of the recording paper 16, and the nozzles 51-11, 51-12, 51-13, 51-14, 51-15 and 51-16 which form one dot row in the main scanning direction of the recording paper 16 constitute a nozzle row 510. The nozzle row 510 is divided into two in the sub-scanning direction, and is therefore constituted by a nozzle row 512 comprising nozzles 51-11, 51-12 and 51-13, and a nozzle row 514 comprising nozzles 51-14, 51-15 and 51-16. Furthermore, the nozzle row 512 and the nozzle row 514 are staggered in phase in the main scanning direction by a distance of ½ of the nozzle pitch P in the main scanning direction. Nozzle rows having the same structure as the nozzle row 510 are arranged in the main scanning direction.

In the case of a print head 50 of this kind, desirably, supply restrictors 53A and nozzles 51 are processed by irradiating the row of condensed laser beams 135 (see FIG. 11) independently onto each block comprising the nozzle rows 512 and 514 which are divided in the sub-scanning direction and staggered in phase in the main scanning direction.

As well as stabilizing the pressure loss balance among the pressure chambers 52, this also makes it possible to reduce the visibility of non-uniformities occurring in the group of dots formed on the recording paper 16, as described hereinafter.

In the print head 50 shown in FIG. 16 and FIG. 17, when the nozzles 51-11, 51-12, . . . , 51-16 constituting the nozzle row 510 are projected to an alignment in the main scanning direction, the nozzle 51-14 is situated centrally between the nozzle 51-11 and the nozzle 51-12, as shown in FIG. 17. Similarly, the nozzle 51-15 is positioned between the nozzle 51-12 and nozzle 51-13, and the nozzle 51-16 is positioned between the nozzle 51-13 and the nozzle 51-21 of the nozzle row which is adjacent to the nozzle row 510 in the main scanning direction.

Figure 18:
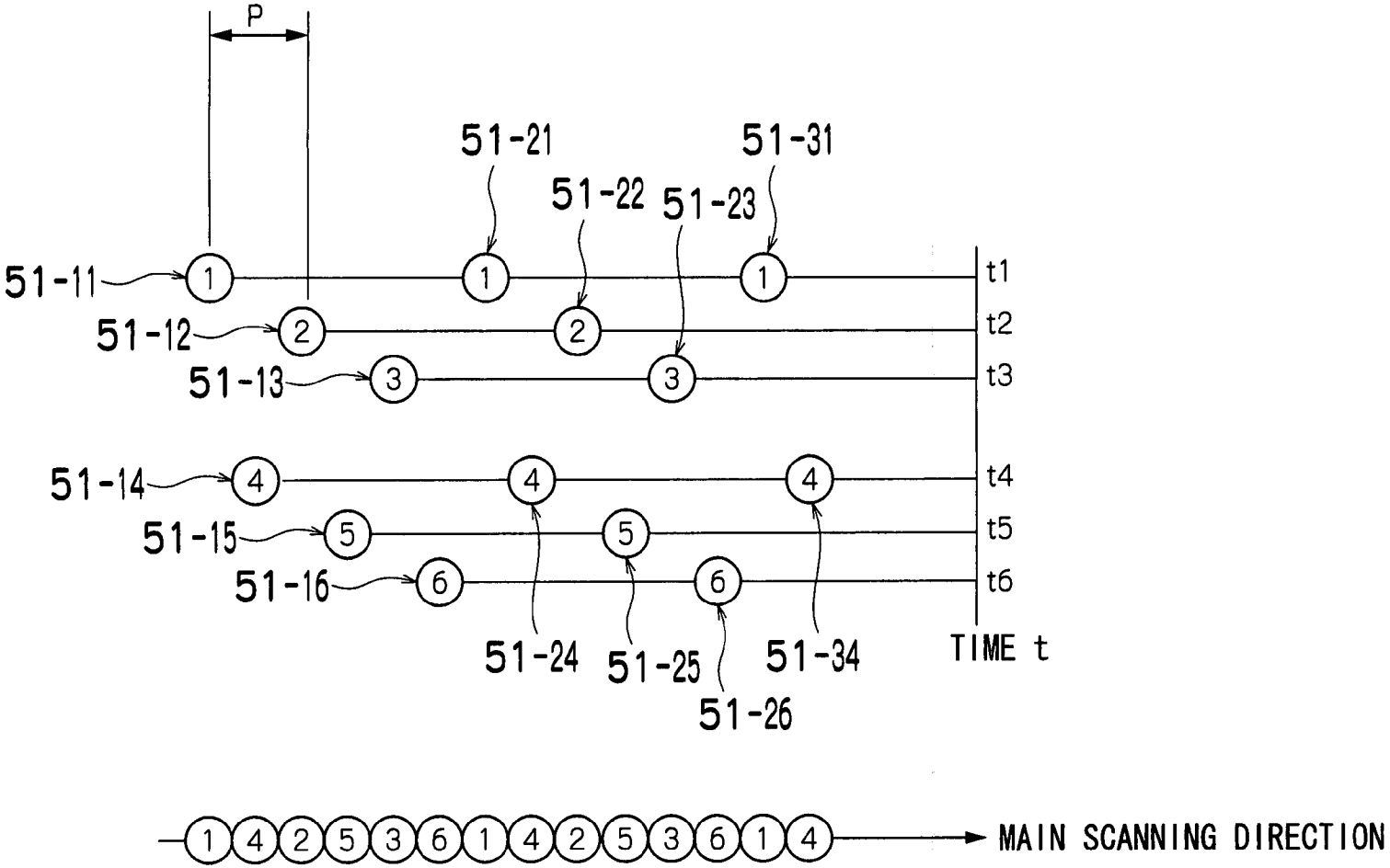
FIG. 18 is an illustrative diagram of the droplet ejection timing in the print head shown in FIG. 16 and FIG. 17.

FIG. 18 is an illustrative diagram of the droplet ejection timing in the print head 50 shown in FIG. 16 and FIG. 17. The numbers shown inside the circles representing the nozzles 51 indicate the droplet ejection timing, and at timing t1, droplets are ejected from nozzle 51-11, nozzle 51-21, nozzle 51-31, and so on. Next, at timing t2, droplets are ejected from nozzles 51-12, and so on. Furthermore, at timing t3 to timing t6, droplets are ejected from nozzles 51-13, and so on, nozzle 51-16, nozzle 51-26, nozzle 51-36, and so on, and therefore, by means of one cycle of droplet ejection at timing t1 to timing t6, it is possible to form a row of dots in one line in the main scanning direction, as shown in the lower part of FIG. 18.

Here, in the droplet ejection performed at timings t1 to t3, the ink droplets ejected at the respective timings do not make contact with each other on the recording paper 16 and do form dots mutually independently. The nozzle-to-nozzle pitch P in the main scanning direction is determined in such a manner that the ink droplets ejected at timing t1 to timing t3 do not interfere with each other on the recording paper 16.

On the other hand, at timing t4 to timing t6, when an ejected ink droplet lands on the paper, other ink droplets have already been deposited at the adjacent droplet deposition positions on either side thereof in the main scanning direction, and when the ink droplets ejected at timings t4 to t6 land on the recording paper, they make contact with the ink droplets on either side which have been previously deposited on the recording paper 16.

In other words, the ink droplet ejected at timing t4 is deposited between the ink droplets ejected at timing t1 and timing t2, and similarly, the ink droplet ejected at timing t5 is deposited between the ink droplets ejected at timing t2 and timing t3, and the ink droplet ejected at timing t6 is deposited between the ink droplets ejected at timing t1 and timing t3.

Since the ink droplets ejected at timing t4 to timing t6 are drawn toward the adjacent ink droplets on both sides which have been deposited previously, then the ink droplets ejected at timing t4 to timing t6 are not drawn in one direction only, and hence the visibility of non-uniformity arising at the return positions (nozzle row joint sections), such as that between nozzle 51-16 and nozzle 51-21, can be reduced.

Figure 19:
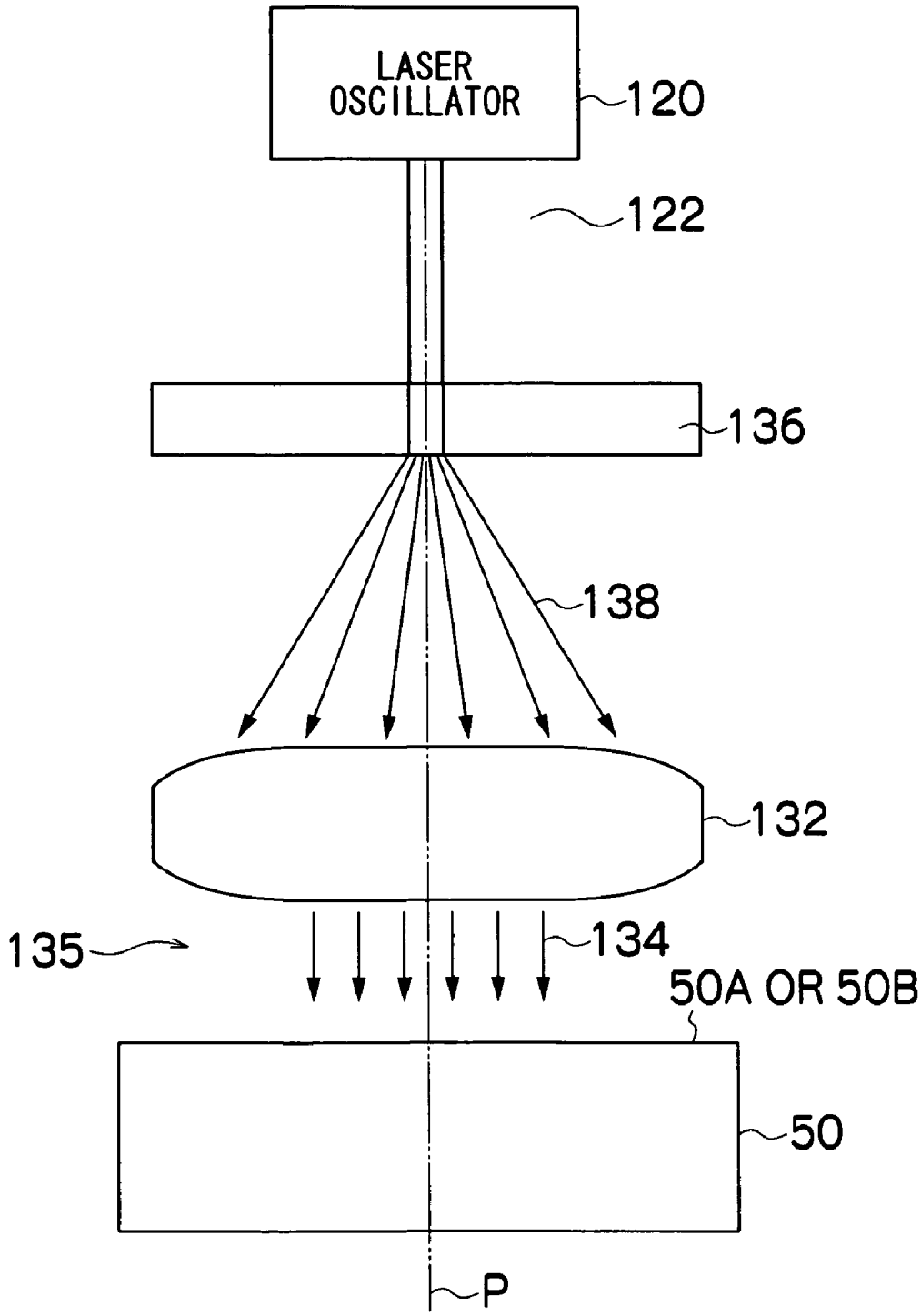
FIG. 19 is an illustrative diagram showing an approximate illustration of a further method for processing supply restrictors and nozzles.

FIG. 19 is an illustrative diagram showing an approximate illustration of a further method for processing supply restrictors 53A and nozzles 51. As shown in FIG. 19, a diffraction grating 136 is disposed in the direction of irradiation of the laser beam 122 irradiated from the laser oscillator 120 (the downward direction in FIG. 19). When the laser beam 122 is incident onto the diffraction grating 136, a plurality of radiating laser beams 138 are emitted from approximately the central region of the diffraction grating 122.

When the plurality of radiating laser beams 138 are incident onto the telecentric lens system 132, they are corrected into parallel beams with respect to the optical axis P, and are condensed by a prescribed factor, in such a manner that a row of condensed laser beams 135 similar to that in FIG. 11 is emitted.

If, similarly to the foregoing, this row of condensed laser beams 135 is irradiated respectively onto the non-nozzle surface 50B of the print head 50 and the nozzle surface 50A thereof, and hence the supply restrictors 53A and nozzles 51 connected via pressure chambers 52 are processed by means of the same condensed laser beams 134, then the pressure loss ratio among the pressure chambers 52 can be made uniform, and therefore it is possible to stabilize the pressure loss balance and, consequently, the amount of ink ejected from each of the nozzles 51.

Composition of Ink Supply System

FIG. 20 is a conceptual diagram showing the composition of an ink supply system in an inkjet recording apparatus 10. As shown in FIG. 20, the inkjet recording apparatus 10 comprises a sub tank 61, pumps P1 and P2, buffer tanks 62, 63, and the like, provided between an ink supply tank 67 and the print head 50.

The ink supply tank 67 is a base tank to supply ink and is set in the ink storing and loading unit 14 described with reference to FIG. 1. The aspects of the ink supply tank 67 include a refillable type, a cartridge type, and the like: when the remaining amount of ink is low, the ink supply tank 67 of the refillable type is filled with ink through a filling port (not shown) and the ink supply tank 67 of the cartridge type is replaced with a new one. In the case of changing the ink type in accordance with the intended application, the latter cartridge type is suitable, and it is preferable to represent the ink type information with a bar code or the like on the cartridge, and to perform ejection control in accordance with the ink type.

The sub tank 61 collects ink supplied from the ink supply tank 67 and serves to remove air bubbles in the ink, as far as possible. It is also possible to adopt a composition in which a filter (not illustrated) is provided in order to remove foreign matter and air bubbles, either instead of or in conjunction with the sub tank 61. A sensor (not illustrated) connected by a circuit to the system controller 72 (see FIG. 3) is provided in the sub tank 61, and the presence or absence of ink is determined by the system controller 72. If no remaining ink is determined by the system controller 72, then it is judged that there is no ink left inside the ink supply tank 67.

The buffer tanks 62 and 63 are formed in the vicinity of the print head 50, or integrally with the print head 50, between the sub tank 61 and the print head 50. These buffer tanks absorb the pulsations (internal pressure fluctuations) occurring in the pressure inside the common liquid chamber 55 when the pumps P1 and P2 are driven, and hence they serve to provide a damping effect which maintains the pressure inside the print head 50 at a suitable uniform value.

The vicinity of print head 50 is also provided with a cap 64 as a device to prevent the nozzles 51 from drying out or to prevent an increase in the ink viscosity in the vicinity of the nozzles 51, and a maintenance unit 65 comprising a cleaning blade 66 as a device to clean the nozzle face 50A or the like.

A maintenance unit 65 can be relatively moved with respect to the head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in an image formation standby state, the cap 64 is raised to a predetermined elevated position so as to come into close contact with the print head 50, and the nozzle face 50A of the print head 50 is thereby covered with the cap 64.

Figure 21:
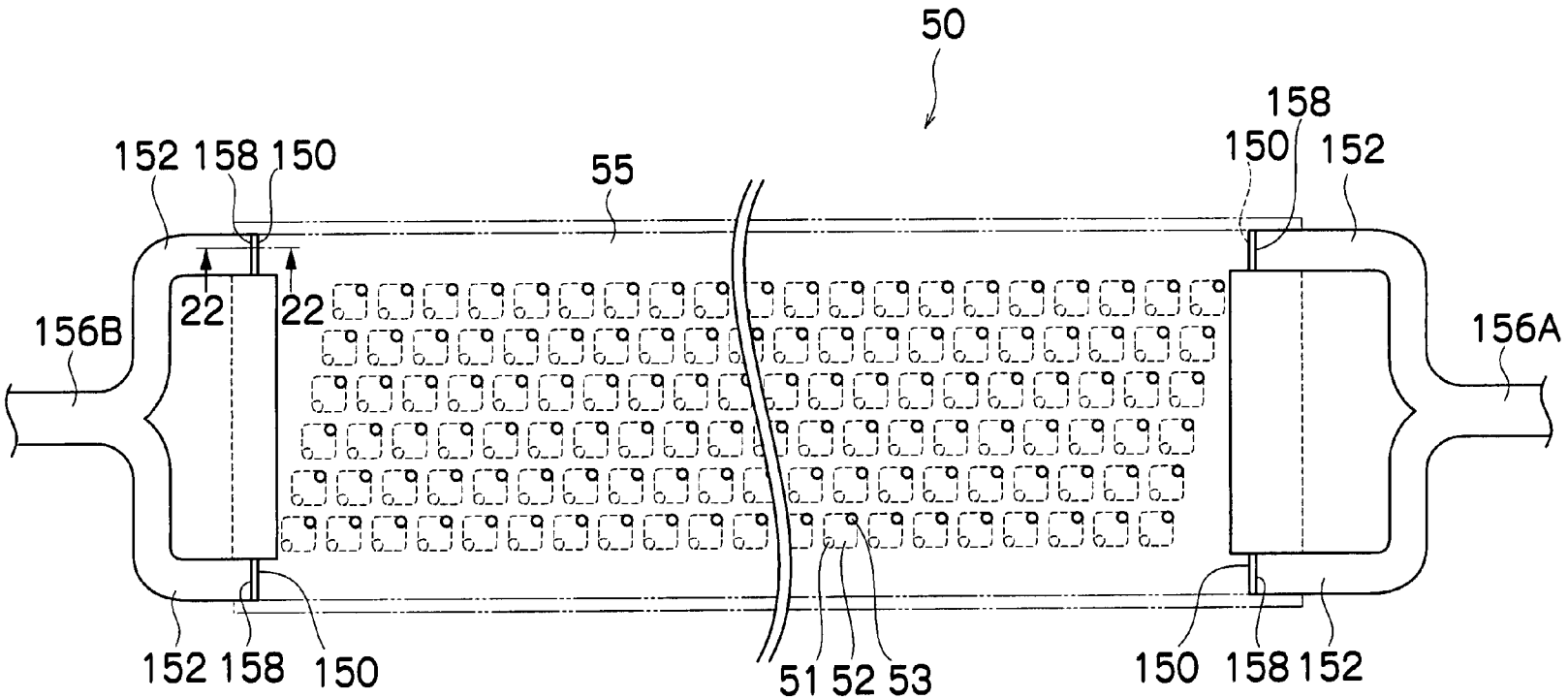
FIG. 21 is a plan view perspective diagram showing the ink supply system of the print head shown in FIG. 20.

FIG. 21 is a plan view perspective diagram showing the ink supply system of the print head 50 shown in FIG. 20. As shown in FIG. 21, the planar shape of the common liquid chamber 55 provided in the print head 50 is composed so as to cover the full surface of the pressure chambers 52 provided in a matrix configuration. Furthermore, as stated above, the common liquid chamber 55 is connected to the pressure chambers 52 by means of the ink supply ports 53.

A main supply port 150 is formed in each corner of the common liquid chamber 55, and a supply tube 152 for supplying ink is connected to each main supply port 150. The main supply ports 150 are provided with filters 158 which can be opened and closed in accordance with the flow of ink. The supply pipes 152 and 152 at either end of the shorter edge of the print head 50 on the right-hand side in FIG. 21 converge to form a main flow channel 156A. Similarly, the supply pipes 152 and 152 at either end of the shorter edge of the print head 50 on the left-hand side in FIG. 21 converge to form a main flow channel 156B. As shown in FIG. 20, the main flow channel 156A is connected to the buffer tank 62, and the main flow channel 156B is connected to the buffer tank 63.

Figure 22A:
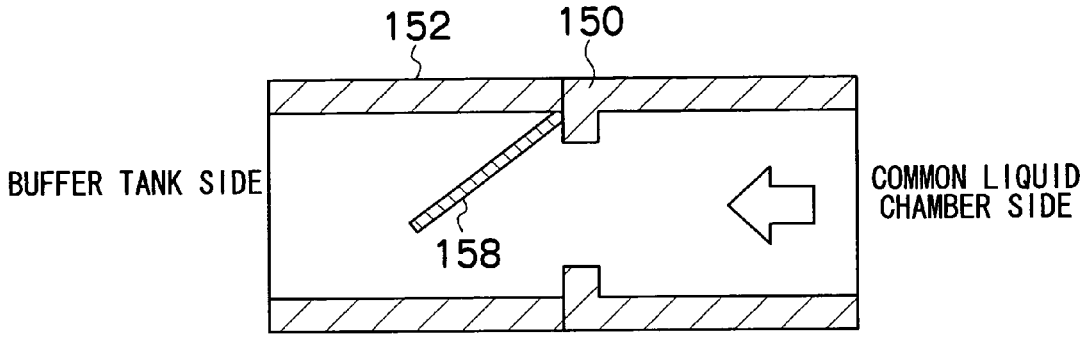
FIGS. 22A and 22B are cross-sectional diagrams along line 22-22 in FIG. 21 showing an example of the composition of a filter.
Figure 22B:
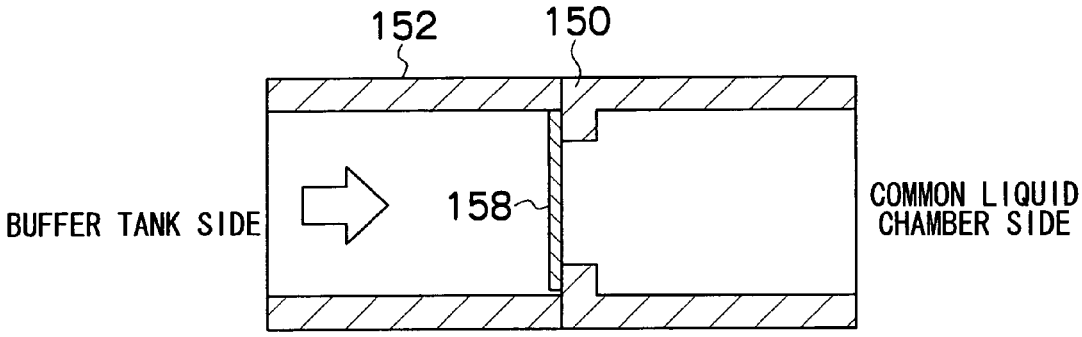

FIGS. 22A and 22B are cross-sectional diagrams showing an example of the composition of a filter 158 (cross-sectional diagrams along line 22-22 in FIG. 21). FIG. 22A shows a state of the filter 158 when ink is expelled from the common liquid chamber 55, and FIG. 22B shows a state of the filter 158 when ink is supplied to the common liquid chamber 55.

As shown in FIG. 22A, the filter 158 is composed in such a manner that it opens the main supply port 150 when the ink flows in the direction from the common liquid chamber 55 toward the buffer tank 63 (the direction indicated by the arrow in FIG. 22A). When the ink is expelled from the common liquid chamber 55, then the foreign matter, and the like, contained in the ink is not blocked by the filter 158, in such a manner that it can be expelled reliably from the common liquid chamber 55.

As shown in FIG. 22B, the filter 158 is composed in such a manner that it closes the main supply port 150 when the ink flows in the direction from the buffer tank 63 toward the common liquid chamber 55 (the direction indicated by the arrow in FIG. 22B). When ink is supplied to the common liquid chamber 55, the foreign matter, and the like, contained in the ink is blocked by the filter 158, and hence infiltration of foreign matter and the like into the common liquid chamber 55 can be prevented.

The filter 158 disposed in the bottom left-hand position in FIG. 21 has a similar composition to that shown in FIGS. 22A and 22B, and the two filters 158 disposed on the right-hand side in FIG. 21 have a laterally symmetrical composition to the composition shown in FIGS. 22A and 22B.

By means of the filters 158 which are able to open and close in accordance with the flow of ink in this manner, it is possible to prevent infiltration of foreign matter or the like into the common liquid chamber 55, while at the same time, if any foreign matter or the like has become infiltrated into the common liquid chamber 55, then this foreign matter can be expelled reliably.

In the composition of an ink supply system for an inkjet recording apparatus 10 shown in FIG. 20 and FIG. 21, when the power supply is switched on to the inkjet recording apparatus 10, the pumps P1 and P2 are both driven as liquid supply devices, and ink is filled into the sub tank 61 and the buffer tanks 62 and 63 until the ink in the sub tank 61 and the buffer tanks 62 and 63 reaches a prescribed level. The ink is supplied to the common liquid chamber 55 from the supply channel 152, via the main supply ports 150, and hence the common liquid chamber 55 becomes filled with ink. In this case the filters 158 provided at the main supply ports 150 assume a state whereby they close off the main supply ports 150 as shown in FIG. 22B, and therefore, infiltration of foreign matter or the like into the common liquid chamber 55 is prevented.

Furthermore, if during image formation or during standby, the use frequency of a particular nozzle 51 has declined and the nozzle 51 has remained in a state of not ejecting an ink droplet for a prescribed waiting time or longer, and if it is judged accordingly by the system controller 72 (see FIG. 3) that a restoration process is required in the print head 50, then the piezoelectric elements 58 of the print head 50 are driven and a preliminary ejection (purge, blank ejection, liquid ejection, dummy ejection) is performed to eject the degraded ink (namely, ink of increased viscosity in the vicinity of the nozzles) from the nozzles 51 toward the cap 64.

Furthermore, in order to ensure that degraded ink is expelled reliably, at least one of the pumps P1 and P2 is driven, thereby supplying the ink under pressure. Accordingly, the degraded ink occurring in the vicinity of the nozzles 51 due to increase in viscosity with the passage of time, and the like, can be expelled reliably.

Also, when bubbles have become intermixed in the ink inside the print head 50, ink can no longer be discharged from the nozzles 51 even if the piezoelectric elements 58 are operated. In situations of this kind, the cap 64 is placed tightly over the nozzle surface 50A of the print head 50, and the pump P3 is driven in order to carry out a restoration process whereby the ink containing air bubbles inside the pressure chambers 52 is suctioned and removed. The ink thus recovered is sent to a recovery tank 68 and then returned, as necessary, to the sub tank 61.

This suction action entails the suctioning of degraded ink of which viscosity has increased (hardened) also when initially loaded into the print head 50, or when service has started after a long period of being stopped.

Since the suction operation is carried out with respect to all of the ink inside the pressure chambers 52, the ink consumption is considerably large. Therefore, desirably, the preliminary ejection described above is carried out while the increase in the viscosity of the ink is still minor.

Furthermore, if foreign matter or the like becomes mixed into the print head 50, then the cap 64 is placed tightly over the nozzle surface 50A of the print head 50, the pump P3 is driven under pressure, thereby applying pressure to the ink inside the pressure chambers 52, and the foreign matter and the like is expelled to the outside of the common liquid chamber 55.

The cleaning blade 66 is composed of rubber or another elastic member, for example, and is provided slidably on the nozzle surface 50A of the print head 50 by means of a blade movement mechanism (wiper; not illustrated). If there are ink droplets or foreign matter adhering to the nozzle surface 50A, then the nozzle surface 50A is wiped by causing the cleaning blade 66 to slide over the nozzle surface 50A, thereby cleaning same. When cleaning by means of the blade mechanism, in order to prevent infiltration of foreign matter into the nozzles 51 due to the action of the cleaning blade 66, a preliminary ejection is carried out after cleaning.

Figure 23:
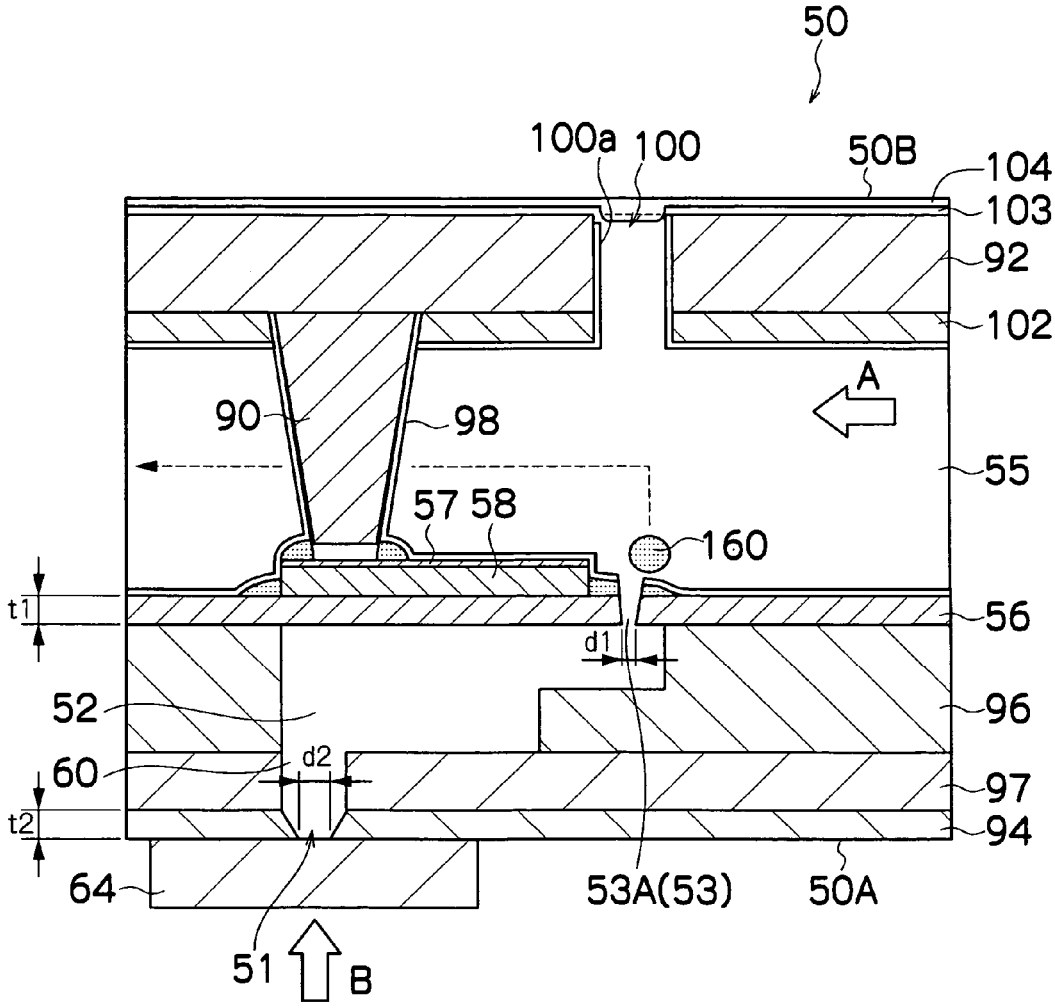
FIG. 23 is an illustrative diagram showing an approximate view of a method for resolving blockages in a supply restrictor.

FIG. 23 is an illustrative diagram showing an approximate view of a method for resolving blockages in a supply restrictor 53A. As shown in FIG. 23, when foreign matter 160, such as dust, has become attached to the side of the supply restrictor 53A adjacent to the common liquid chamber 55, thus producing a blocked state, then there may be cases where the blockage of the supply restrictor 53A cannot be resolved by means of a method in which the degraded ink is removed by preliminary ejection by driving the aforementioned piezoelectric elements 58, or a method in which a cap 64 is placed tightly on the nozzle surface 50A and the pump P3 (see FIG. 20) is driven, thereby removing the ink inside the pressure chamber 52 by suction. Below, a method for resolving a blockage of a supply restrictor 53A will be described with reference to FIG. 20 to FIG. 23.

Image defects are determined by the print determination unit 24 (see FIG. 3) and if the image defects cannot be restored even if preliminary ejection is performed, then the pump P1 is driven as a liquid transmitting device and the pump P2 is driven as a liquid suctioning device, and the ink inside the common liquid chamber 55 is thus circulated in the direction indicated by the arrow A in FIG. 23. It is also possible to drive the pump P1 as a liquid suctioning device and pump P2 as a liquid transmitting device.

Furthermore, as shown in FIG. 23, the cap 64 is placed tightly on the nozzle surface 50A of the print head 50. Using the pump P3, pressure is applied at the position of the cap 64 corresponding to the nozzles 51, in the opposite direction to the direction of ejection of the nozzles 51 (the direction shown by arrow B in FIG. 23).

The pressure applied in this manner is transmitted through the ink inside the pressure chamber 52 and acts in the upward direction in FIG. 23 on the foreign matter 160 adhering to the side of the supply restrictor 53A adjacent to the common liquid chamber 55. In this case, since the ink inside the common liquid chamber 55 flows in the direction shown by the arrow A in FIG. 23, the foreign matter 160 is expelled in the direction of the arrow marked by the broken line in FIG. 23. In this case, the filters 158 provided at the main supply ports 150 assumes a state where they open the main supply ports 150 as shown in FIG. 22A, and therefore, the foreign matter 160 is expelled reliably from the common liquid chamber 55.

In the present embodiment, taking the mesh size of the filters 158 shown in FIGS. 22A and 22B as d0, the hole diameter of the supply restrictor 53A as d1 and the hole diameter of the nozzle 51 as d2, as shown in FIG. 23, then desirably, the relationship of $d0<d1<d2$ is satisfied.

By forming the mesh size d0 of the filters 158 to a smaller dimension than the hole diameter d1 of the supply restrictor 53A, it is possible to prevent blocking of the supply restrictor 53A since no pieces of foreign matter, or the like, larger than the hole diameter d1 of the supply restrictor 53A can enter into the common liquid chamber 55. Furthermore, even if a piece of foreign matter larger than the hole diameter d1 of the supply restrictor 53A does enter into the common liquid chamber 55, blockage of the supply restrictor 53A can be resolved and the foreign matter can be expelled reliably from the common liquid chamber 55, by placing the cap 64 tightly on the nozzle surface 50A of the print head 50 and applying pressure in the direction of the arrow B in FIG. 23 at the position of the cap 64 corresponding to the nozzles 51.

On the other hand, by making the hole diameter d2 of the nozzle 51 larger than the hole diameter d1 of the supply restrictor 53A, it is possible reliably to expel foreign matter or the like which has passed through the supply restrictor 53A, out from the nozzle 51.

Figure 24:
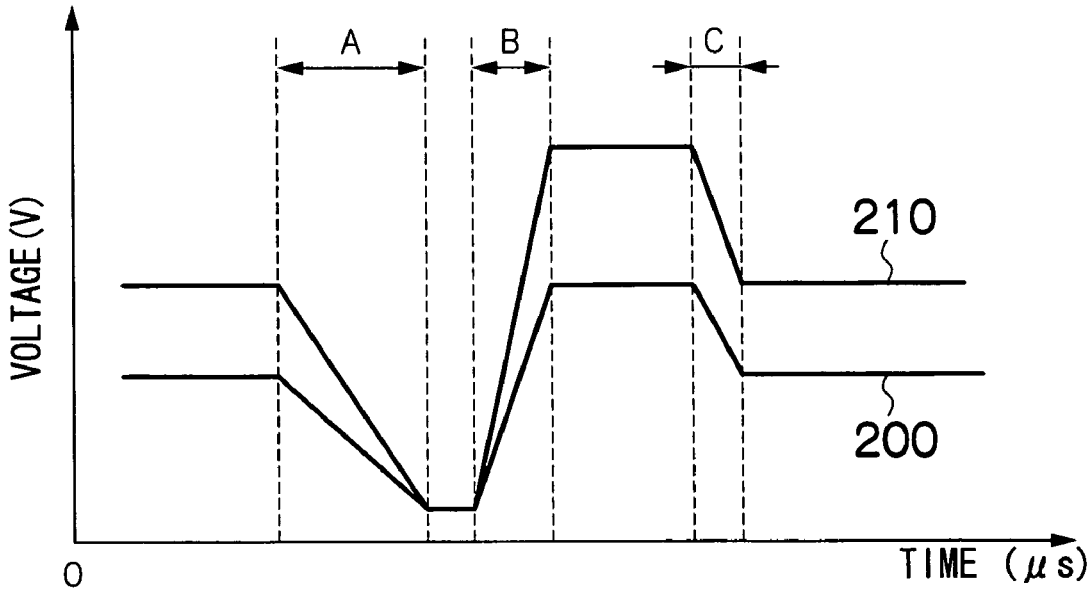
FIG. 24 is an illustrative diagram showing one example of a drive signal waveform.

FIG. 24 shows one example of the waveform of a drive signal (hereafter, called "drive waveform") which is applied to a piezoelectric element 58. The waveform 200 shown in FIG. 24 is applied when performing normal liquid ejection (not for eliminating foreign matter), whereas the waveform 210 having a larger voltage than waveform 200 is applied when eliminating foreign matter. In both of the waveforms 200 and 210, the meniscus of the ink is drawn into the nozzle 51 in section A, ink is expelled from the nozzle 51 in section B, and the vibration of the meniscus of the ink is attenuated in section C. When eliminating foreign matter, by applying a drive waveform having a larger voltage than during normal liquid ejection, it is possible to increase the reflux through the supply restrictor 53A and hence the foreign matter can be removed readily.

The liquid ejection head and the image forming apparatus comprising same according to the present invention have been described in detail above, but the present invention is not limited to the aforementioned examples, and it is of course possible for improvements or modifications of various kinds to be implemented, within a range which does not deviate from the essence of the present invention.

What is claimed is:

1. A liquid ejection head, comprising:

a plurality of ejection ports through which liquid is ejected;

a plurality of pressure chambers which are connected respectively to the ejection ports;

a common liquid chamber in which the liquid to be supplied to the pressure chambers is accumulated;

a plurality of supply flow channels which connect the common liquid chamber to the pressure chambers; and a plurality of supply restrictors each of which constitutes at least a portion of each of the supply flow channels, wherein at least a portion of one of the ejection ports connected to one of the pressure chambers and a portion of one of the supply restrictors connected to the one of the pressure chambers are processed by means of the same laser beam, each supply restrictor comprises an opening in a first plate on a first side of the plurality of pressure chambers, where the opening has a diameter d1 and the first plate has a thickness t1, and each ejection port comprises an opening in a second plate on a second side of the plurality of pressure chambers, opposed to the first side, where the opening has a diameter d2 and the second plate has a thickness t2, wherein d1<d2, and the relationship $$t1/d1^4 \approx t2/d2^4$$

is satisfied.

2. The liquid ejection head as defined in claim 1, wherein at least portions of the ejection ports and at least portions of the supply restrictors connected respectively to the pressure chambers are processed by means of the same row of plurality of laser beams.

3. The liquid ejection head as defined in claim 1, wherein at least a portion of a member forming the supply restrictors and at least a portion of a member forming the ejection ports are made of substantially the same material.

4. A liquid ejection apparatus, comprising:

the liquid ejection head as defined in claim 1; and a pressing device which is provided in vicinity of a surface on which the ejection ports are formed, and applies a pressure to the liquid inside the ejection ports in a direction opposite to a direction of flight of the liquid ejected from the ejection ports.

5. The liquid ejection apparatus as defined in claim 4, further comprising:

a supply port through which the liquid is supplied to the common liquid chamber; and an outlet which is capable of expelling the liquid accumulated in the common liquid chamber.

6. An image forming apparatus, comprising the liquid ejection apparatus as defined in claim 4.

7. The liquid ejection apparatus as defined in claim 4, wherein the pressing device includes a cap positioned on the surface on which the ejection ports are formed and a pump coupled to the cap to apply the pressure to the ejection ports in a direction opposite to the direction of flight of the liquid ejected from the ejections ports.

8. An image forming apparatus, comprising the liquid ejection head as defined in claim 1.

9. The liquid ejection head as defined in claim 1, further comprising:

a supply port which is formed with the common liquid chamber and is connected with a pipe for supplying the liquid; and a filter which is formed with the supply port and has a valve function that takes opening and closing actions according to a flow of the liquid, wherein, when the liquid flows from the pipe toward the common liquid chamber, the filter closes the supply port and the liquid is supplied to the common liquid, chamber through the filter, and when the liquid flows from the common liquid chamber toward the pipe, at least a portion of the supply port is opened so that the liquid is discharged from the common liquid chamber not through the filter.

10. The liquid ejection head as defined in claim 1, further comprising:

a plurality of piezoelectric elements which are formed across the plurality of pressure chambers from the plurality of ejection ports and deform the plurality of pressure chambers respectively;

a sealing member which is formed across the common liquid chamber from the plurality of piezoelectric elements, is connected to a circuit driving each of the plurality of piezoelectric elements, and seals the liquid in the common liquid chamber; and wiring members for driving the plurality of piezoelectric elements, at least one portion of the wiring members erecting through the common liquid chamber substantially perpendicularly to a surface in which the plurality of piezoelectric elements are arranged, wherein the common liquid chamber is arranged across the plurality of pressure chambers from the plurality of ejection ports, the sealing member has holes which correspond with supply channels connecting the common liquid chamber with the plurality of pressure chambers and which are arranged substantially directly above positions of the supply channels, and the supply channels corresponding to the holes are formed after formation of the common liquid chamber.

11. A manufacturing method of the liquid ejection head as defined in claim 1, wherein the liquid ejection head further comprises:

a plurality of piezoelectric elements which are formed across the plurality of pressure chambers from the plurality of ejection ports and deform the plurality of pressure chambers respectively;

a sealing member which is formed across the common liquid chamber from the plurality of piezoelectric elements, is connected to a circuit driving each of the plurality of piezoelectric elements, and seals the liquid in the common liquid chamber; and wiring members for driving the plurality of piezoelectric elements, at least one portion of the wiring members erecting through the common liquid chamber substantially perpendicularly to a surface in which the plurality of piezoelectric elements are arranged, wherein the common liquid chamber is arranged across the plurality of pressure chambers from the plurality of ejection ports, the sealing member has holes which correspond with supply channels connecting the common liquid chamber with the plurality of pressure chambers and which are arranged substantially directly above positions of the supply channels, and the manufacturing method includes the steps of: forming the common liquid chamber, and forming the supply channels corresponding to the holes after formation of the common liquid chamber.

12. The manufacturing method as defined in claim 11, wherein after the formation of the common liquid chamber and film processing applied to the common liquid chamber, at least a portion of the supply channels are formed.

13. The manufacturing method as defined in claim 12, wherein the film processing is applied to the common liquid chamber by sending an agent for the film processing from an ink tank to the common liquid chamber.

14. The manufacturing method as defined in claim 11, wherein the at least a portion of the supply channels that are formed after the formation of the common liquid chamber is a supply restrictor.

* * * * *